US007712877B2

(12) United States Patent
Hirota et al.

(10) Patent No.: US 7,712,877 B2
(45) Date of Patent: May 11, 2010

(54) INKJET PRINTER AND A METHOD OF MANUFACTURING AN INKJET PRINTER

(75) Inventors: Atsushi Hirota, Nagoya (JP); Chitoshi Ueki, Kokubu (JP); Shin Ishikura, Kokubu (JP)

(73) Assignee: Brother Kogyo Kabushiki Kaisha, Nogoya-shi, Aichi-ken (JP)

( * ) Notice: Subject to any disclaimer, the term of this patent is extended or adjusted under 35 U.S.C. 154(b) by 887 days.

(21) Appl. No.: 11/382,915

(22) Filed: May 11, 2006

(65) Prior Publication Data

US 2006/0256164 A1 Nov. 16, 2006

(30) Foreign Application Priority Data

May 13, 2005 (JP) ..... 2005-140844

(51) Int. Cl.
*B41J 2/045* (2006.01)
*B41J 29/38* (2006.01)

(52) U.S. Cl. ..... 347/68; 347/11

(58) Field of Classification Search ..... 347/72
See application file for complete search history.

(56) References Cited

U.S. PATENT DOCUMENTS

| | | | |
|---|---|---|---|
| 5,291,248 | A | 3/1994 | Isobe |
| 6,033,051 | A | 3/2000 | Kaneko |
| 6,109,736 | A | 8/2000 | Miyata et al. |
| 6,174,040 | B1 | 1/2001 | Hotomi |
| 6,494,555 | B1 | 12/2002 | Ishikawa |

(Continued)

FOREIGN PATENT DOCUMENTS

JP 61144358 A * 7/1986

(Continued)

OTHER PUBLICATIONS

U.S. Patent and Trademark Office, Office Action in co-pending U.S. Appl. No. 11/382,862, Notification Date Jun. 2, 2009.

(Continued)

*Primary Examiner*—Matthew Luu
*Assistant Examiner*—Lisa M Solomon
(74) *Attorney, Agent, or Firm*—Baker Botts L.L.P.

(57) ABSTRACT

An inkjet printer whose ink discharge characteristic will rarely change even when used for a long period of time is developed. The inkjet printer has a pressure chamber and a piezoelectric actuator and a controller. The piezoelectric actuator has a first electrode, a first piezoelectric film, a second electrode, a second piezoelectric film, and a third electrode, and they are laminated together in this order. The piezoelectric actuator forms a portion of the wall defining the pressure chanter. The controller applies ink discharge signal between the first and second electrode, ink discharge signal comprises advanced voltage change from a predetermined voltage to the lower voltage and subsequent voltage change from the lower voltage to the predetermined voltage. Ink can be effectively discharged by applying the ink discharge signal, but the ink discharge signal could change piezoelectric characteristic in the second piezoelectric film due to the deformation of the first piezoelectric film. The additional signal applying the second piezoelectric film via the second and the third electrode can reduce the changes of the piezoelectric characteristic. As a result, changes of ink discharge characteristic can be prevented.

9 Claims, 14 Drawing Sheets

U.S. PATENT DOCUMENTS

| | | | | |
|---|---|---|---|---|
| 6,672,715 | B2 | 1/2004 | Isono et al. | |
| 6,676,238 | B2 | 1/2004 | Fujimura et al. | |
| 7,537,300 | B2 | 5/2009 | Hirota | |
| 2004/0080585 | A1 | 4/2004 | Iriguchi | |
| 2004/0108790 | A1* | 6/2004 | Junhua et al. | 310/311 |
| 2004/0246315 | A1* | 12/2004 | Takahashi | 347/71 |
| 2006/0256148 | A1 | 11/2006 | Hirota et al. | |
| 2006/0256163 | A1 | 11/2006 | Hirota et al. | |
| 2006/0284908 | A1 | 12/2006 | Iwao | |

FOREIGN PATENT DOCUMENTS

| | | | |
|---|---|---|---|
| JP | S61-144358 | A | 7/1986 |
| JP | H04-115951 | A | 4/1992 |
| JP | 2003 308582 | | 10/2003 |

OTHER PUBLICATIONS

U.S. Patent and Trademark Office, Office Action in co-pending U.S. Appl. No. 11/382,841, Notification Date Apr. 3, 2008.

U.S. Patent and Trademark Office, Office Action in co-pending U.S. Appl. No. 11/382,862, Notification Date Dec. 14, 2009.

* cited by examiner ( a )

( b )

( a )

( b )

INKJET PRINTER AND A METHOD OF MANUFACTURING AN INKJET PRINTER

CROSS REFERENCE TO RELATED APPLICATION

This application claims priority to Japanese Patent Application No. 2005-140844 filed on May 13, 2005, the contents of which are hereby incorporated by reference into the present application.

BACKGROUND OF THE INVENTION

1. Field of the Invention

The present invention relates to an inkjet printer and a method of manufacturing an inkjet printer.

2. Description of the Related Art

An Inkjet printer having a pressure chamber, a piezoelectric actuator and a controller is known. The pressure chamber communicates with the nozzle.

The pressure chamber is filled with ink when the inkjet printer is used, and the piezoelectric actuator can apply pressure to the ink within the pressure chamber. When the ink within the pressure chamber is pushed by the piezoelectric actuator, ink is discharged from the nozzle. In this way, the inkjet printer will print text and/or image on a printing medium.

A conventional inkjet printer is disclosed in Japanese Patent Application Publication No. 2003-305852.

The piezoelectric actuator is arranged so as to form at least a portion of a wall defining the pressure chamber. The piezoelectric actuator has a piezoelectric film. The piezoelectric film extends along the portion of the wall, and has electrodes attached on both surfaces of the piezoelectric film.

By applying voltage difference between the electrodes, the piezoelectric film deforms due to the piezoelectric effect. As a result, the piezoelectric actuator deforms. Because the piezoelectric actuator forms a portion of the wall defining the pressure chamber, the volume of the pressure chamber changes due to the deformation of the piezoelectric actuator. By deforming the piezoelectric actuator so that the volume of the pressure chamber becomes smaller, pressure can be applied to the ink within the pressure chamber. By applying pressure to the ink within the pressure chamber, the ink will be discharged from the nozzle that communicates with the pressure chamber.

The so-called "fill before fire" method is often used in order to improve ink discharge efficiency by the piezoelectric actuator. In this method, the following operations are performed. According to "fill before fire" method, a predetermined voltage is applied to the piezoelectric film of the piezoelectric actuator prior to ink discharge operation. Due to the predetermined voltage, the piezoelectric film deforms so as to project toward the pressure chamber. Due to the deformation of the piezoelectric film which is in the piezoelectric actuator, the piezoelectric actuator deforms projecting toward the pressure chamber. When the piezoelectric actuator deforms projecting toward the pressure chamber, the volume of the pressure chamber becomes smaller. When the ink is to be discharged, an ink discharge signal is applied to the piezoelectric film. The ink discharge signal is composed of a combination of an advanced voltage change and a subsequent voltage change. In the advanced voltage change, voltage applied to the piezoelectric film is changed from the predetermined voltage that has been applied to the piezoelectric film to the lower voltage. Due to the advanced voltage change, deformation of the piezoelectric actuator is loosened, and the volume of the pressure chamber is increased. At the timing when the volume of the pressure chamber is increased, a negative pressure is generated within the pressure chamber. The generated pressure decrease develops a pressure wave within the pressure chamber. The developed pressure wave will propagate from the pressure chamber to the nozzle through an ink passage communicating the pressure chamber and the nozzle, and the pressure wave is reflected at the nozzle toward the pressure chamber. The reflected pressure wave will return to the pressure chamber. Due to reciprocation of the pressure wave, the pressure within the pressure chamber varies cyclically between a negative pressure and a positive pressure.

According to "fill before fire" method, the subsequent voltage change is applied to the piezoelectric film while the pressure wave continues. In the subsequent voltage change, voltage applied to the piezoelectric film is changed from the lower voltage that has been applied to the piezoelectric film to the predetermined voltage. Due to the subsequent voltage change, the piezoelectric actuator is deformed again, and the volume of the pressure chamber is decreased. According to "fill before fire" method, the subsequent voltage change is applied when positive pressure is developed within the pressure chamber due to the pressure wave generated by the advanced voltage change. In this method, the deformation of the piezoelectric actuator to decrease the volume of the pressure chamber and to increase the pressure within the pressure chamber occurs at timing when the pressure within the pressure chamber is increased to the positive value due to the pressure wave. Therefore, a large positive pressure is developed within the pressure chamber by the subsequent voltage change, and ink is effectively discharged from the nozzle. High discharge efficiency may be obtained by "fill before fire" method. The time period from the advanced voltage change to the subsequent voltage change is critical to obtain high ink discharge efficiency.

To simplify the description, regarding to the electrodes which sandwich the piezoelectric film, the one of the electrodes which is farther than the other electrode from the pressure chamber will be referred to as a first electrode and the other electrode will be referred to as a second electrode.

BRIEF SUMMARY OF THE INVENTION

The piezoelectric actuator of the inkjet printer recited in Japanese Patent Application Publication No. 2003-305852 has other piezoelectric film. To simplify the description, the piezoelectric film sandwiched between the pair of electrodes will be referred to as the first piezoelectric film, and the other piezoelectric film will be referred to as the second piezoelectric film.

The second piezoelectric actuator is positioned between the second electrode and the pressure chamber. In other words, the first electrode, the first piezoelectric film, the second electrode, and the second piezoelectric film are laminated in this order. Therefore, the second piezoelectric film deforms while the piezoelectric actuator deforms.

If the inkjet printer employs the "fill before fire" method, the piezoelectric characteristics of the piezoelectric actuator having the first and the second piezoelectric film may change remarkably while the printer is used for a long time. As a result, the ink discharge characteristics may change. The piezoelectric characteristics, as referred to herein, is the relationship between voltage level applied to the first piezoelectric film and the deformation of the piezoelectric actuator induced thereby. The ink discharge characteristics, as referred to herein, is the amount of ink discharged from the nozzle at a time and/or the speed of ink discharged from the nozzle. Changes of the piezoelectric characteristics of the piezoelectric actuator may occur in the following situation.

In the "fill before fire" method, the predetermined voltage continues to be applied between the pair of electrodes (i.e., the first and the second electrode) sandwiching the first piezoelectric film while ink is not discharged from the nozzle. The region sandwiched between the pair of electrodes in the first piezoelectric film is referred to as the main active portion. The predetermined voltage continues to be applied while ink is not discharged from the nozzle, so the main active portion is maintained in a state contracted fixedly in a certain direction during a period that ink is not discharged from the nozzle.

In the "fill before fire" method, voltage applied to the pair of electrodes is only lowered from the predetermined voltage during a period applied the ink discharge signal. During a period applied the ink discharge signal, the fixed contracted state of the main active portion is eased from the fixed contraction caused by the application of the predetermined voltage.

The length of the period that ink is not discharged from the nozzle depends on the images to be printed. Thus, depending on the situation, the length of that period may be prolonged. On the other hand, a period in which the lower voltage is applied to the first piezoelectric film is shorter than the period that ink is not discharged from the nozzle. In other words, the main active portion repeats longer fixed contracted state and shorter eased contracted state alternatively.

The above-mentioned conventional inkjet printer has the second piezoelectric film. In the second piezoelectric film, the region facing the main active portion of the first piezoelectric film is referred to as the opposing portion. The first piezoelectric film and the second piezoelectric film are laminated together, so when the main active portion contracts, the opposing portion deforms under fixed compressive stress suffering from the main active portion.

When the contraction of the main active portion is shortly eased periodically after long period in which the main active portion is maintained to the fixed contracted state, the opposing portion is also periodically eased the continuously suffering fixed stress. In other words, the opposing portion suffers the long continuing fixed stress periodically.

When this condition continues for a long time, the direction of spontaneous polarization of the crystal grain units in the opposing portion will shift toward a direction perpendicular to a direction of the stress applied. The direction perpendicular to the direction of the stress applied is substantially equal to a direction of lamination of the first piezoelectric film and the second piezoelectric film. Hereafter, a direction of spontaneous polarization oriented along the direction of lamination of the first and the second piezoelectric film is referred to as a c-axis orientation. The proportion of crystal grains with the c-axis orientation is referred to as the degree of c-axis orientation. Using the word "the c-axis orientation", the periodic stress causes a shift of the direction of spontaneous polarization of the crystal grain units in the opposing portion toward the c-axis orientation. In other words, the number of crystal grain units whose spontaneous polarization is oriented along the c-axis orientation increases due to the stress. In other words, the periodic stress increases the degree of c-axis orientation in the opposing portion. If the degree of c-axis orientation in the opposing portion will increase, the deformation of the opposing portion caused by the stress fails to return when the stress is eased. As a result, the shape of the opposing portion shifts from its initial shape. Therefore, the piezoelectric characteristics of the piezoelectric actuator will change due to the shift of the shape of the opposing portion.

Furthermore, the main active portion will undergo stress from the shape-shifted opposing portion even in a period that the ink discharge signal is applied. This undergoing stress will also cause the change of the piezoelectric characteristics of the piezoelectric actuator.

The change of the piezoelectric characteristics of the piezoelectric actuator reduces the amount of deformation of the piezoelectric actuator when voltage is applied to the pair of electrodes. Therefore, the amount of change in the volume of the pressure chamber during the ink discharge operation will decrease. The amount of ink discharged from the nozzle at a time will decrease. The speed of ink discharged from the nozzle will be slow.

As has been discussed, the long-term use of a conventional inkjet printer results in a change of the piezoelectric characteristics of the piezoelectric actuator and a consequent change of the ink discharge characteristics.

A first object of the present invention is to provide an inkjet printer whose ink discharge characteristics will rarely change, even if the inkjet printer is used for a long period of time. A second object of the present invention is to provide a manufacturing method of an inkjet printer in which the ink discharge characteristics will rarely change, even if the inkjet printer is used for a long period of time.

An inkjet printer according to the present invention has a pressure chamber, a piezoelectric actuator, and a controller. The pressure chamber communicates with a nozzle. The pressure chamber is capable of being filled with ink. In other words, the pressure chamber is filled with ink when the inkjet printer is used. The piezoelectric actuator forms at least a portion of a wall defining the pressure chamber.

The first electrode, the first piezoelectric film, the second electrode, the second piezoelectric film, and the third electrode are laminated together in this order. The first electrode is positioned within a region overlapping with the portion of the wall along a direction of lamination of the piezoelectric films and electrodes. The second electrode and the third electrode are positioned so that the second and the third electrodes at least partially overlap with the first electrode along the direction of lamination. In other words, the first electrode, the second electrode, and the third electrode at least partially overlap each other along the direction of lamination at least in the region corresponding to the portion of the wall defining the pressure chamber.

The piezoelectric actuator deforms so as to project toward the pressure chamber and to decrease a volume of the pressure chamber while the controller applies voltage between the first electrode and the second electrode.

The controller can apply voltage between the first electrode and the second electrode and between the third electrode and the second electrode independently. The controller applies an ink discharge signal between the first electrode and the second electrode when ink discharge operation is required. The ink discharge signal contains an advanced voltage change and a subsequent voltage change. The advanced voltage change changes voltage from a predetermined voltage to a lower voltage. The subsequent voltage change changes voltage from the lower voltage to the predetermined voltage. The subsequent voltage change may be delayed for a predetermined period from the advanced voltage change. The predetermined period may be selected so that the subsequent voltage change is applied when the pressure within the pressure chamber is increased to positive pressure due to the pressure wave generated by the advanced voltage change. The subsequent voltage change applied at this timing may effectively increase the pressure within the pressure chamber. Therefore, ink is effectively discharged from the nozzle. The combination of the volume increase and the subsequent volume decrease of the pressure chamber due to the ink discharge signal causes ink to discharge from the nozzle.

The controller further applies an additional signal between the second electrode and the third electrode.

The inkjet printer may comprise a plurality of pressure chambers and nozzles. If the inkjet printer comprises a plurality of pressure chambers, the inkjet printer comprises a number of first electrodes identical to the number of pressure chambers.

As described above, the region sandwiched between the first electrode and second electrode in the first piezoelectric film is referred to as the main active portion. The region sandwiched between the second electrode and the third electrode in the second piezoelectric film is referred to as a laminated active portion. The active portion and the laminated active portion at least partially overlap each other along the direction of lamination.

As described above, in a conventional inkjet printer, the change of the piezoelectric characteristics of the piezoelectric actuator are caused by the increase of the degree of c-axis orientation in the opposing portion.

In the inkjet printer of the present invention, the controller applies the additional signal between the second electrode and third electrode. By the applied additional signal, certain voltage is applied to the laminated active portion. Note that the laminated active portion at least partially overlaps with the above mentioned opposing portion.

If the additional signal is applied to the laminated active portion sufficiently to increase the degree of c-axis orientation of the laminated active portion to a certain level before the ink discharge operation starts, there may be little potential to increase the degree of c-axis orientation in the laminated active portion during the ink discharge operation. As a result, changes of the piezoelectric characteristics of the piezoelectric actuator may be effectively suppressed while using the inkjet printer, which employs the "fill before fire" method. In other words, the increase in the degree of the c-axis orientation in the laminated active portion by the ink discharge operation may be kept within a certain range. This will suppress a change of the piezoelectric characteristics of the main active portion. As a result, changes of ink discharge characteristics will be reduced. It is preferred to apply the additional signal before the inkjet printer is actually used. However, the additional signal may be applied while the inkjet printer is in use.

The present invention provides a manufacturing method of an inkjet printer. The manufacturing method according to the present invention has processes of forming a passage unit, forming a piezoelectric actuator, connecting the formed passage unit and the formed piezoelectric actuator, and applying voltage to the piezoelectric actuator.

In the process of forming the passage unit, a passage unit having a nozzle and a pressure chamber is formed. The passage unit is formed so that the pressure chamber communicates with the nozzle, and so as to open a portion of the pressure chamber.

In the process of forming the piezoelectric actuator, the piezoelectric actuator having a first electrode, a first piezoelectric film, a second electrode, a second piezoelectric film, and a third electrode is formed. The piezoelectric actuator is formed so that the first electrode, the first piezoelectric film, the second electrode, the second piezoelectric film, and the third electrode are laminated in this order.

In the process of connecting, the formed passage unit and the formed piezoelectric actuator are connected as follows.

The piezoelectric actuator is connected to the passage unit so as to cover the opened portion of the pressure chamber. The piezoelectric actuator is connected to the passage unit so that the first electrode is positioned within a region that overlaps with the pressure chamber along a direction of lamination of the piezoelectric films. The piezoelectric actuator is connected to the passage unit so as to deform toward the pressure chamber when voltage is applied between the first electrode and the second electrode.

In the process of applying voltage, voltage is applied between the second electrode and the third electrode so as to polarize a portion of the second piezoelectric film sandwiched by the second electrode and the third electrode.

According to this manufacturing method, voltage is applied to the laminated active portion. The degree of c-axis orientation in the laminated active portion can therefore be reached at a certain level. At the beginning of using the manufactured inkjet printer which employs the "fill before fire" method, there is little potential to increase the degree of c-axis orientation in the laminated active portion during the ink, discharge operation, because the degree of c-axis orientation in the laminated active portion is already reached to a certain level. Therefore, changes of the piezoelectric characteristics of the piezoelectric actuator can be suppressed while using the inkjet printer, which employs the "fill before fire" method, for a long time. An inkjet printer in which the ink discharge characteristics will rarely change, even if the inkjet printer is used for a long period of time can be manufactured.

BRIEF DESCRIPTION OF THE DRAWINGS

FIG. 7(*b*) illustrates a change in the electric potential of individual electrodes when the ink discharge signal shown in FIG. 7(*a*) is applied.

DETAILED DESCRIPTION OF THE INVENTION

Figure 1:
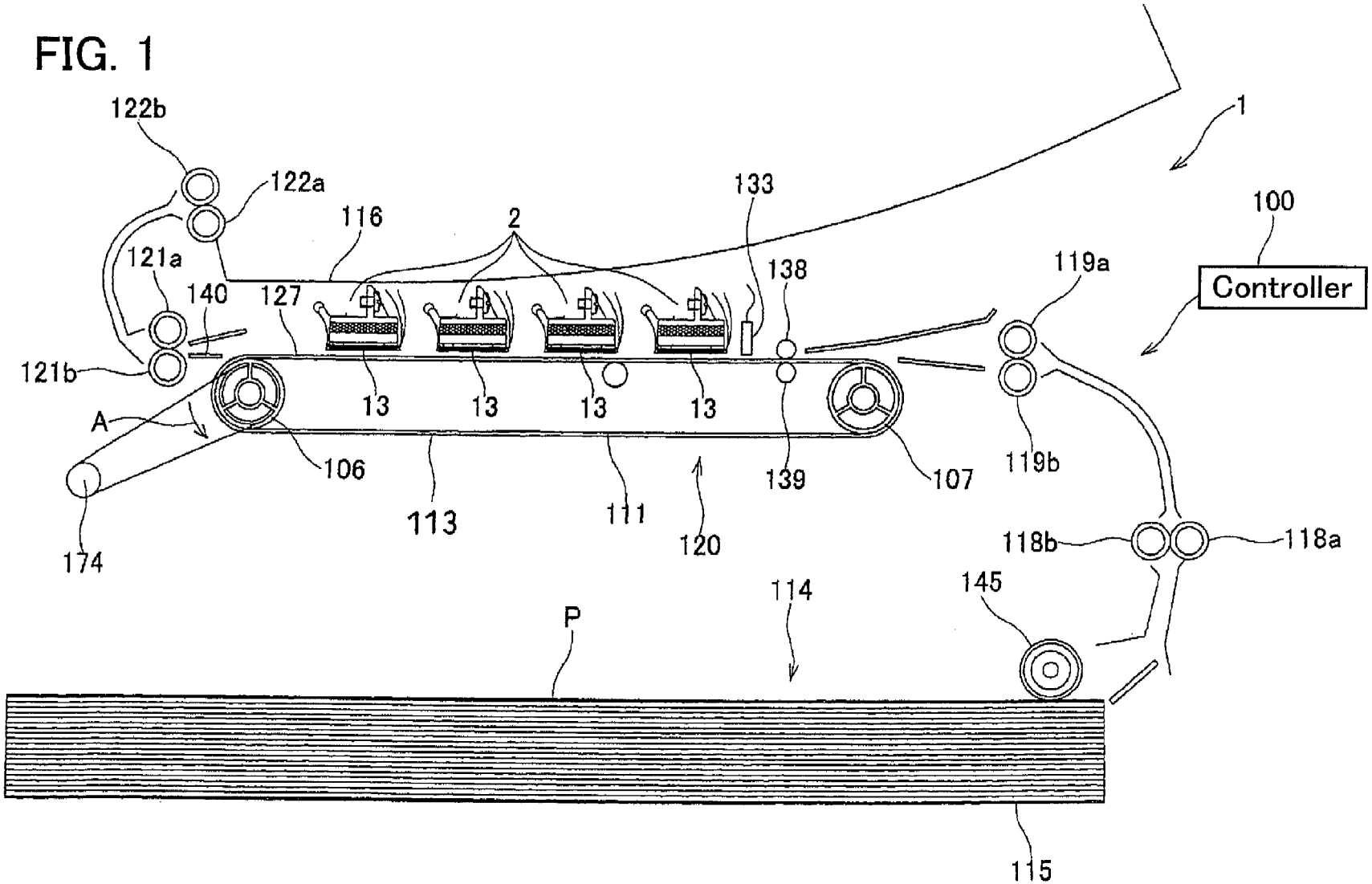
FIG. 1 is a schematic drawing of an inkjet printer of an embodiment.

Preferable technical features of the invention are described below.

The lower voltage in the ink discharge signal applied by the controller may be substantially equal to zero voltage.

If the lower voltage is set to zero voltage, the main active portion is temporarily released from deformation during the ink discharge operation. Therefore, the laminated active portion is also repeatedly released from stress cause by the deformation of the main active portion. If such a state is maintained without applying the additional signal, the characteristic change of the piezoelectric actuator would become even more significant. Even in this case, the characteristics changes of the piezoelectric actuator, as described above, can be suppressed by applying the additional signal between the third electrode and the second electrode.

The controller generates the predetermined voltage during applying the ink discharge signal between the first electrode and the second electrode. The controller may apply the predetermined voltage between the second electrode and the third electrode as the additional signal. The controller may apply same voltage (the predetermined voltage) both of in the ink discharge signal and in the additional signal. The structure or the circuit of the controller can be simplified.

The controller may apply the additional signal while the controller applies no ink discharge signal.

As described earlier, the additional signal may be applied between the second electrode and the third electrode in order to apply voltage to the laminated active portion of the second piezoelectric film. Voltage applied to the laminated active portion may deform the laminated active portion. The deformation of the laminated active portion during the ink discharge operation affects the ink discharge characteristics.

According to the above mentioned technical feature, voltage is not applied to the laminated active portion while the ink discharge operation is taking place. The ink characteristics change by applying the additional signal during the ink discharge operation can be avoided.

The controller may apply constant voltage between the second electrode and the third electrode as the additional signal.

According to the above mentioned technical feature, the controller is required only applying constant voltage as the additional signal. Such a controller can be simply configured.

The second electrode may be held at constant electric potential.

According to the above mentioned technical feature, the controller need not change the electric potential of the second electrode. The controller may independently apply signals to the first electrode and the third electrode, so the controller can be simply configured.

The inkjet printer may have a counter counting a count of matching a predetermined condition. In this case, the controller may apply additional signal until the count reaches a predetermined number.

The predetermined condition refers to, for example, the condition of ink being discharged. The counter may alternatively be a device that counts the time since the start of printer use. In this case, the count counted by the counter refers to the time since the start of printer use.

The predetermined count reached by the counter is preferably set so that the degree of c-axis orientation of the laminated active portion is adequately large. If this is done, excess voltage need not be applied between the second electrode and the third electrode after the degree of c-axis orientation of the laminated active portion has become adequately large. The power consumption of the inkjet printer is thereby reduced.

An inkjet printer may have a first electro-conductive member making electrical contact with ink filled in the pressure chamber. The electric potential of the first electro-conductive member may be held at the same electric potential as the third electrode.

The third electrode is positioned nearer to the pressure chamber than the first electrode and the second electrode. When the ink in the pressure chamber is charged at an electric potential differing from that of the third electrode, the ink in the pressure chamber is pulled toward the third electrode, or the piezoelectric actuator. If the ink in the pressure chamber is pulled toward the piezoelectric actuator, the ink may enter into the piezoelectric actuator. Any ink entering the piezoelectric actuator could cause the changes of piezoelectric characteristics of the piezoelectric actuator.

According to the above mentioned technical feature, the ink in the pressure chamber is held at an electric potential identical to that of the third electrode by the first electro-conductive member. The invasion of ink of the pressure chamber into the piezoelectric actuator may thus be avoided.

The first electro-conductive member may form a portion of the wall defining the pressure chamber.

According to the above mentioned technical feature, the ink of the pressure chamber is simply and consistently held at an electric potential identical to that of the third electrode.

The inkjet printer may have a fourth electrode and a second electro-conductive member. The second electro-conductive member electrically connects the fourth electrode and ink filled in the pressure chamber. The fourth electrode extends along the third electrode beyond a region corresponding to the pressure chamber. The fourth electrode has no electrical contact with the third electrode.

According to the above mentioned technical feature, the fourth electrode is located closer to the pressure chamber than the first electrode, the second electrode, and the third electrode. The ink in the pressure chamber is held at an electric potential identical to that of the fourth electrode by the second electro-conductive member. The pulling of ink of the pressure chamber into the piezoelectric actuator, mentioned above, can be avoided. In other words, the invasion of ink into the piezoelectric actuator can be avoided.

Preferred embodiments of the present invention will be described with reference to the attached drawings.

<Outline of the Inkjet Printer>

FIG. 1 is a schematic view of a color inkjet printer according to an embodiment of the present invention. This color inkjet printer 1 (hereinafter referred to as a printer 1) has four inkjet heads 2. These inkjet heads 2 are fixed to the printer 1. These inkjet heads 2 are arranged along the direction in which a printing sheet P is conveyed. Each inkjet head 2 has a long shape that extends from the front of FIG. 1 to the rear thereof.

A paper supply unit 114, a paper receiving section 116, and a conveying unit 120 are provided in the printer 1. In addition, a controller 100 is provided in the printer 1 in order to control the operation of each portion of the printer 1, such as the inkjet heads 2 and the paper supply unit 114.

The paper supply unit 114 has a paper storage case 115 that can store a plurality of printing sheets P, and a paper supply roller 145. The paper supply roller 145 can feed the uppermost printing sheet P of the printing sheets that are stacked and stored in the paper storage case 115, one sheet at a time.

A pair of feed rollers 118*a* and 118*b*, and a pair of feed rollers 119*a* and 119*b*, are arranged between the paper supply unit 114 and the conveying unit 120, and along the conveyance path of the printing sheets P. The printing sheet P fed from the paper supply unit 114 is further fed toward the conveying unit 120 by means of these feed rollers.

The conveying unit 120 has an endless conveyor belt 111, and two belt rollers 106 and 107. The conveyor belt 111 is wrapped around the belt rollers 106 and 107. The conveyor belt 111 is adjusted so that a predetermined tension is applied thereto when wrapped around the two belt rollers. In this way, the conveyor belt 111 is stretched between the two belt rollers 106 and 107 without any slack. The surface of the conveyor belt 111 near the inkjet head 2 is a conveying surface 127 that conveys the printing paper P.

As shown in FIG. 1, a conveying motor 174 is connected to the belt roller 106. The conveying motor 174 can rotate the belt roller 106 in the direction of the arrow A. In addition, the belt roller 107 can rotate in association with the conveyor belt 111. Thus, by driving the conveying motor 174 in order to rotate the belt roller 106, the conveyor belt 111 will rotate in the direction of the arrow A.

A nip roller 138 and a nip receiving roller 139 are arranged near the belt roller 107 so as to sandwich the conveyor belt 111. The nip roller 138 is urged downward by a spring not shown in the drawings. The nip receiving roller 139 below the nip roller 138 stops the nip roller 138 that is urged downward via the conveyor belt 111. The nip roller 138 and the nip receiving roller 139 are rotatably disposed, and rotate in association with the rotation of the conveyor belt 111.

Printing paper P fed from the paper supply unit 111 toward the conveying unit 120 is grasped between the nip roller 138 and the conveyor belt 111. In this way, the printing paper P is pressed onto the conveying surface 127 of the conveyor belt 111, and fixed on the conveying surface 127. Then, the printing paper P is conveyed in the direction in which the inkjet heads 2 are disposed, in accordance with the rotation of the conveyor belt 111. Note that the outer peripheral surface 113 of the conveyor belt 111 may be treated with an adhesive silicone rubber. In this way, the printing paper P can be reliably fixed to the conveying surface 127.

The four inkjet heads 2 are arranged near each other along the direction in which the printing paper P is conveyed by the conveyor belt 111. Each inkjet head 2 has a head main body 13 on the lower edge thereof. A large number of nozzles 8 (not shown in FIG. 1) that discharge ink are provided in the lower surface of the head main body 13. The same color of ink will be discharged from the nozzles 8 provided on one ink jet head 2. The colors of the ink discharged from each inkjet head 2 are, respectively, magenta (M), yellow (Y), cyan (C), and black (K). Each inkjet head 2 is arranged so that there is a slight gap between the lower surface of the head main body 13 and the conveying surface 127 of the conveyor belt 111.

A printing sheet P fixed to the conveying surface 127 of the conveyor belt 111 will pass between the inkjet head 2 and the conveyor belt 111. When this occurs, ink will be discharged from the nozzles 8 of the head main body 13 toward the upper surface of the printing sheet P. In his way, a color image based on image data stored by the controller 100 (see FIG. 6) will be printed on the upper surface of the printing sheet P.

A peel plate 140 and two pairs of feed rollers 121*a* and 121*b*, and 122*a* and 122*b*, are arranged between the conveying unit 120 and the paper receiving section 116. The printing paper P on which a color image has been printed is conveyed toward the peel plate 140 by the conveyor belt 111. At this point, the printing paper P is peeled from the conveying surface 127 by the right side of the peel plate 140 in FIG. 1. Then, the printing paper P is fed to the paper receiving section 116 by the feed rollers 121*a*-122*b*. Thus, printing papers P on which images have been printed will be sent to the paper receiving section 116. These printing papers P will be stacked onto the paper receiving section 116.

Note that a paper sensor 133 is disposed between the inkjet head 2 on the furthest upstream side in the direction in which the printing papers P are conveyed, and the nip roller 138. The paper sensor 133 is constructed from a light emitting element and a light receiving element. The paper sensor 133 will detect the leading edge of a printing sheet P in the conveying passage. The detection results are transmitted from the paper sensor 133 to the controller 100. The controller 100 will control the inkjet head 2, the conveying motor 174, and the like so that the conveyance of the printing paper P and the printing of the images are synchronized, based upon the detection signal transmitted from the paper sensor 133.

<Head Main Body>

Figure 2:
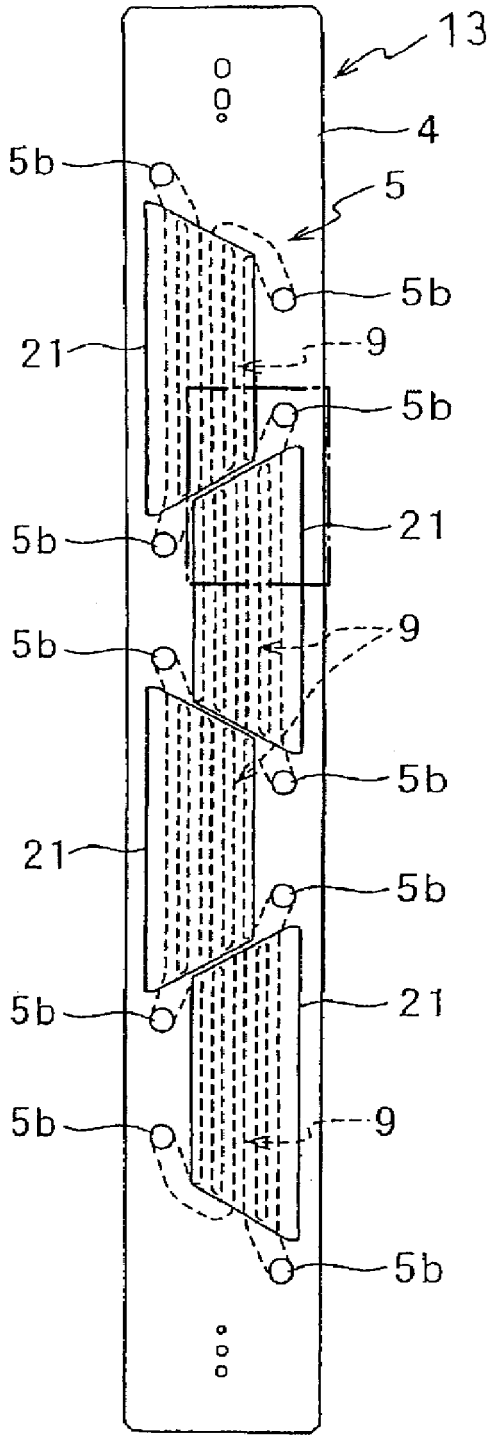
FIG. 2 is a plan view of a head main body shown in FIG. 1.

The head main body 13 will be described. FIG. 2 is a plan view of the head main body 13 shown in FIG. 1 when viewed from the upper surface thereof.

The head main body 13 has a passage unit 4, and actuator units 21 that are adhered to the passage unit 4. Each actuator unit 21 has a trapezoidal shape. The actuator units 21 are arranged on the upper surface of the passage unit 4 so that the pair of opposing parallel sides of each trapezoid is parallel with the lengthwise direction of the passage unit 4. In addition, four actuator units 21 are arranged on the upper surface of the passage unit 4 along the lengthwise direction of the passage unit. The adjacent actuator units 21 are arranged so that the trapezoids are arranged to face in opposite directions along the width of the passage unit 4. In addition, the adjacent actuator units 21 are arranged to be relatively offset along the width of the passage unit 4. A diagonal side of one trapezoid and adjacent diagonal side of the trapezoid adjacent to the one trapezoid partially overlap along the width of the passage unit.

A manifold passage 5 that is a portion of the ink passage is formed in the interior of the passage unit 4. Openings 5*b* of the manifold passage 5 are formed on the upper surface of the passage unit 4. Five openings 5*b* are arranged along one edge of the passage unit 4 in the lengthwise direction. Another five openings 5*b* are arranged along another edge of the passage unit 4 in the lengthwise direction. In the plan view of FIG. 2, the openings 5*b* are formed in positions outside the regions in which the four actuator units 21 are arranged. Ink is supplied from an ink tank not shown in the drawings, through the openings 5*b*, to the manifold passage 5.

Figure 3:
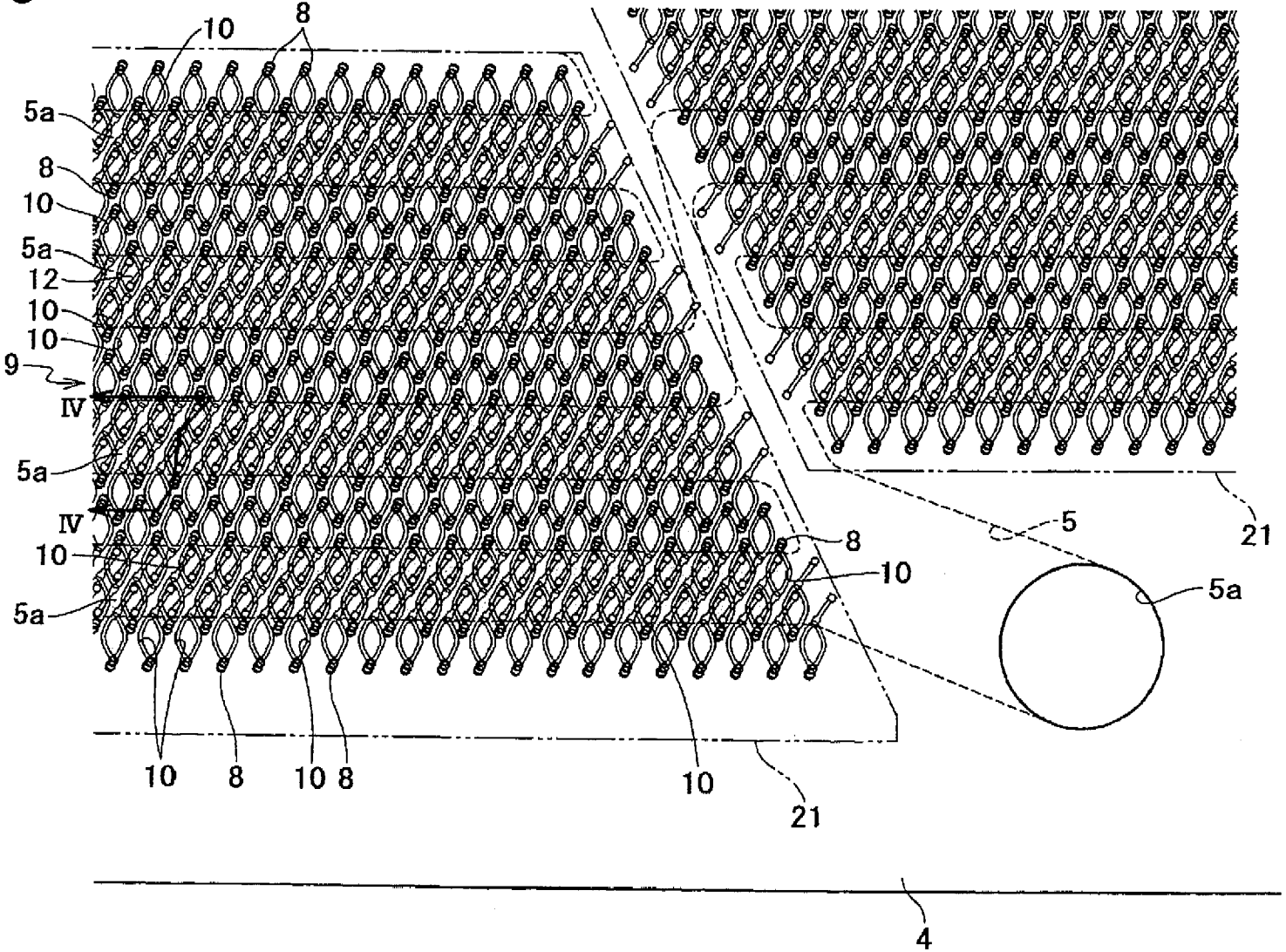
FIG. 3 is an enlarged view of the region that is surrounded by the thick broken line in FIG. 2.

FIG. 3 is an enlarged plan view of the region surrounded by the thick broken line of FIG. 2. Note that illustration of the actuator units 21 is omitted in FIG. 3 in order to make FIG. 3 easier to understand. In other words, FIG. 3 is a plan view of the head main unit 13 in a state in which the actuator units 21 are not arranged on the upper surface of the passage unit 4. In addition, the components formed in the interior and lower surface of the passage unit 4, such as apertures 12 and nozzles 8, should be shown with broken lines in FIG. 3, but are shown with solid lines therein.

A plurality of sub-manifold passages 5*a* branch from the manifold passage 5 formed inside the passage unit 4. These sub-manifold passages 5*a* extend inside the passage unit 4 so as to be mutually adjacent with the regions that are opposite each actuator unit 21.

The passage unit 4 has pressure chamber groups 9 in which the pressure chambers 10 are formed in a lattice pattern. The pressure chambers 10 are hollow regions having a flat rhomboid shape in which the corners are rounded. The pressure chambers 10 are formed so as to open on the upper surface of the passage unit 4. These pressure chambers 10 are arranged along substantially the entire surface of the region that faces the actuator units 21 on the upper surface of the passage unit 4. In other words, the plurality of pressure chambers 10 are covered by the actuator units 21 on the upper surface of the passage unit 4. Each pressure chamber group 9 that are formed by these pressure chambers 10 have substantially the same size and shape as an actuator unit 21 in the direction perpendicular to the top surface of the passage unit 4.

A large number of nozzles 8 are formed on the lower surface of the passage unit 4. These nozzles 8 are arranged in positions that avoid the sub-manifold passages 5*a* in the plan view of FIG. 3. In addition, these nozzles 8 are arranged in regions that face the actuator units 21 in the plan view of FIG. 3. The nozzles 8 in each respective region are aligned in parallel lines in the lengthwise direction of the passage unit 4 with equal intervals.

The plurality of nozzles 8 are arranged as described below. Here, it will be assumed that there is an imaginary straight line that is parallel with the lengthwise direction of the passage unit 4. Projection points that project from every nozzle 8 along a direction perpendicular with the imaginary straight line toward the imaginary straight line are aligned with uniform, uninterrupted intervals. The interval corresponds to the print resolution. By arranging the nozzles 8 in this manner, the inkjet head 2 can print in uninterrupted intervals corresponding to the print resolution, along substantially the entire region in which the nozzles 8 are formed on the passage unit 4 in the lengthwise direction.

A large number of apertures (choke) 12 are formed in the interior of the passage unit 4. The apertures 12 are disposed in a region that faces the pressure chamber groups 9 in the plan view of FIG. 3. In the present embodiment, the apertures 12 extend along one direction that is parallel with the horizontal plane (the plane that is parallel with the plan view in FIG. 3).

Communication holes are formed in the interior of the passage unit 4. The communication holes are formed in order to mutually communicate with pressure chamber 10, the apertures 12 corresponding to the pressure chamber 10, and the nozzles 8 corresponding to the pressure chamber 10. These communication holes communicate with each other, and form the individual ink passages 32 (see FIG. 4). Each individual ink passage 32 communicates with the sub-manifold passages 5*a* at one end thereof. Ink supplied to the manifold passage 5 passes through the sub-manifold passages 5*a*, is branched to each individual ink passage 32, and is discharged from the nozzles 8.

<Individual Ink Passages>

Figure 4:
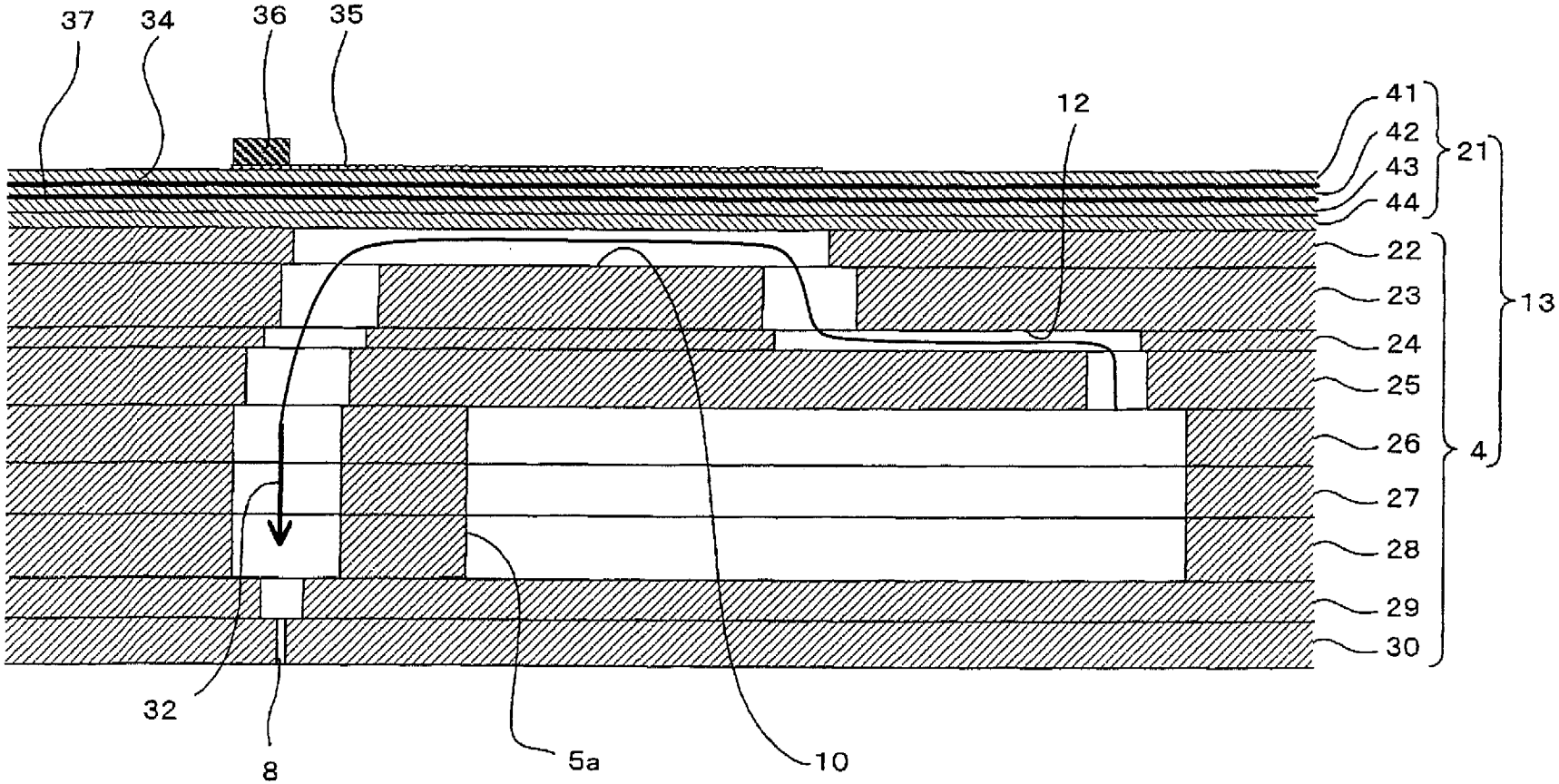
FIG. 4 is a longitudinal cross-sectional view corresponding to line IV-IV shown in FIG. 3.

The individual ink passages 32 will be described with regard to the cross-sectional structure of the head main unit 13. FIG. 4 is a vertical cross-sectional view corresponding to line IV-IV shown in FIG. 3.

The passage unit 4 that is included in the head main unit 13 has a laminated structure in which a plurality of plates are laminated. These plates are, from the upper surface of the passage unit 4, a cavity plate 22, a base plate 23, an aperture plate 24, a supply plate 25, manifold plates 26, 27, 28, a cover plate 29, and a nozzle plate 30. A large number of communication holes are formed in these plates. When each plate is laminated, the communication holes formed in each plate communicate with each other so as to form the individual ink passages 32 and the sub-manifold passages 5*a*. In other words, each plate is positioned and laminated so that the individual ink passages 32 and the sub-manifold passages 5*a* are formed by means of the communication holes.

The communication holes formed in each plate will be described. The following elements are in these communication holes.

First, the pressure chambers 10 formed in the cavity plate 22.

Second, a communication hole group A that forms a passage that communicates from one end of the pressure chamber 10 to the sub-manifold passage 5*a*. The communication hole group A is formed in each plate from the base plate 23 to the supply plate 25. Note that the aperture 12 formed in the aperture plate 24 is included in the communication hole group A.

Third, a communication hole group B that forms a passage that communicates from the other end of the pressure chamber 10 to the nozzle 8. The communication hole group B is formed in each plate from the base plate 23 to the cover plate 29.

Fourth, the nozzle 8 formed in the nozzle plate 30.

Fifth, a communication hole group C that forms the sub-manifold passage 5*a*. The communication hole group C is formed in the manifold plates 26-28.

The individual ink passages 32 are formed due to the mutual communication of the communication holes. Ink supplied to the sub-manifold passage 5*a* will flow to the nozzle 8 through the individual ink passage 32 by following way. The ink will flow upward from the sub-manifold passage 5*a* to one end of the aperture 12. Next, the ink will flow horizontally along the lengthwise direction of the aperture 12 to the other end of the aperture 12. The ink will flow upward from the other end of the aperture 12 to one end of the pressure chamber 10. Furthermore, the ink will flow horizontally along the lengthwise direction of the pressure chamber 10 to the other end of the pressure chamber 10. The ink will flow from the other end of the pressure chamber 10 diagonally downward through the ink passage 32 that passes through three plates (the base plate 23, the aperture plate 24, and the supply plate 25). The ink will then flow to the nozzle 8 formed in the nozzle plate 30, via the ink passage 32 that passes through four plates (the manifold plates 26-28, and the cover plate 29).

<Actuator Units>

As shown in FIG. 4, the actuator unit 21 has a laminated structure in which four plates are laminated together, i.e., the piezoelectric film 41 (first piezoelectric film), the piezoelectric film 42 (second piezoelectric film), the piezoelectric film 43, and the piezoelectric film 44. These piezoelectric films 41-44 each have a thickness of approximately 15 μm. The overall thickness of the actuator unit 21 is approximately 60 μm. Any layer of the piezoelectric films 41-44 extends so as to cover the plurality of pressure chambers 10 (see FIG. 3). In other words, as shown in FIG. 4, the actuator unit 21 forms a portion of the wall defining the pressure chamber 10. These piezoelectric films 41-44 are comprised of lead zirconate titanate (PZT) type of ceramic material having ferroelectric properties.

The actuator unit 21 has three types of electrodes that are comprised of a metal material such as Ag—Pd or the like. These electrodes are an individual electrode 35 (first electrode), a common electrode 34 (second electrode), and a sub-common electrode 37 (third electrode).

The individual electrode 35 is arranged in a region facing the pressure chamber on the upper surface of the piezoelectric film 41. In other words, the individual electrode 35 is arranged in a region overlapping with the wall defining the pressure chamber 10 along a direction of lamination of the piezoelectric films 41-44.

A land 36 is formed on one end of the individual electrode 35. The land 36 is composed of a metal that includes glass frit, for example. The land 36 is formed in a convex shape having a thickness of approximately 15 μm on the upper surface of the individual electrode 35. In addition, the land 36 is electrically bonded to a contact arranged on a FPC (flexible printed circuit) not shown in the drawings. As described below, the controller 100 can transmit various electrical signals (voltage pulse train signals) to the individual electrode 35 through the FPC.

The common electrode 34 extends over almost the entire surface of the piezoelectric film in the planar direction between the piezoelectric film 41 and the piezoelectric film 42. In other words, the common electrode 34 extends so as to cover all of the pressure chambers 10 facing the actuator unit 21. The thickness of the common electrode is approximately 2 μm. The common electrode 34 is grounded in a region not shown in the drawings and is kept at ground potential.

As shown in FIG. 4, the individual electrode 35 and the common electrode 34 are arranged so as to sandwich only the uppermost piezoelectric film 41 (first piezoelectric film). Hereafter, the region sandwiched between the individual electrode 35 and the common electrode 34 in the piezoelectric film 41 is referred to as the main active portion. And in the piezoelectric film 42 (second piezoelectric film), the region facing the main active portion of the piezoelectric film 41 is referred to as the opposing portion.

In the present embodiment, the main active portion is a region where voltage is applied by the controller 100 via the individual electrode 35 and the common electrode 34. The main active portion will deform due to the piezoelectric effect when a voltage is applied thereto. In the present embodiment, voltage is applied between the individual electrode 35 and the common electrode 34 to discharge ink from the pressure chamber 10. In other words, voltage is applied to the main active portion sandwiched between the individual electrode 35 and the common electrode 34 in the piezoelectric film 41 to discharge ink from the pressure chamber 10.

In the actuator unit 21 of the present embodiment, only the uppermost piezoelectric film 41 includes the main active portion, and the other piezoelectric films 42-44 do not include a main active portion. In other words, the actuator unit 21 has a so-called unimorph type structure.

The sub-common electrode 37 extends over almost the entire surface of the piezoelectric film in the planar direction, between the piezoelectric film 42 and the piezoelectric film 43. In other words, the sub-common electrode 37 extends so as to cover all of the pressure chambers 10 facing the actuator unit 21. Therefore, the common electrode 34 and the sub-common electrode 37 sandwich the piezoelectric film 42 across nearly the entire surface thereof. Hereafter, the region sandwiched between the common electrode 34 and the sub-common electrode 37 in the piezoelectric film 42 is referred to as the laminated active portion. The opposing portion is included in the laminated active portion. The sub-common electrode 37 is electrically connected to the FPC in a region not shown in the drawings. The controller 100 (see FIG. 1) can apply a variety of voltage signals between the common electrode 34 and the sub-common electrode 37. The voltage signals applied by the controller 100 are discussed below.

Figure 5:
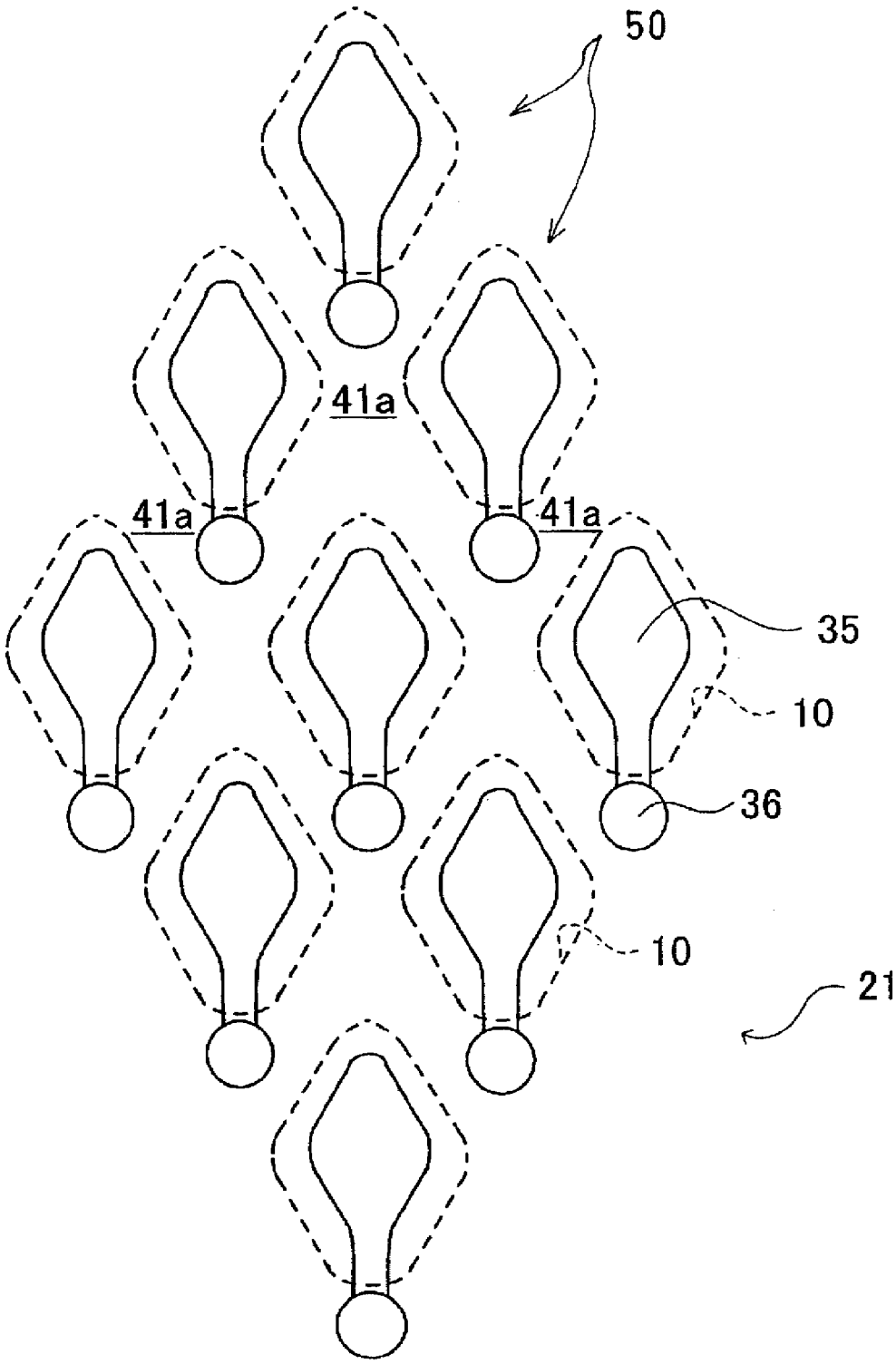
FIG. 5 is a partial enlarged plan view of the top of the actuator unit shown in FIG. 3.

FIG. 5 is an enlarged plan view of the actuator unit 21 when viewed from the upper surface of the actuator unit 21 shown in FIG. 3. The individual electrode 35 has a substantially flat rhomboid shape that resembles the shape of the pressure chamber 10. The planar size of the individual electrode 35 is slightly smaller than that of the pressure chamber 10. One of the acute angular portions of the individual electrode 35 extends in a direction that is opposite that of the other acute angular portion. The tip of the extending portion forms the land 36. The land 36 has a flat circular shape.

A portion of the rhomboid shaped individual electrode 35 is arranged in the approximate center of the region that faces the pressure chamber 10 formed below the individual electrode 35. In contrast, the portion that extends from the acute angular portion of the individual electrode 35 extends beyond the region that faces the pressure chamber 10. On the surface of the piezoelectric film 41, in other words, the land 36 is arranged in a region 41*a* that faces a portion in which a pressure chamber 10 is not formed in the cavity plate 22.

In the piezoelectric film 41, the common electrode 34 (not shown in FIG. 5) is positioned on the surface facing the surface to which the individual electrode 35 is adhered. As will be discussed later, certain voltage signal is applied between the individual electrode 35 and the common electrode 34 to deform the main active portion due to the piezoelectric effect in the piezoelectric film 41. As a result, a region of the piezoelectric actuator unit 21 corresponding to the main active portion is deformed so as to project toward the pressure chamber 10. In this way, the volume of the pressure chamber 10 will become smaller. Pressure will be applied to the ink inside the pressure chamber 10 that corresponds to the individual electrode 35. As a result, ink will pass through the individual ink passage 32, and be discharged from the corresponding nozzle 8. In other words, the portions of the actuator unit 21 that face each corresponding pressure chamber 10 will form individual actuators 50 (piezoelectric actuators) that corresponds to each pressure chamber 10 and nozzle 8. The individual actuators 50 forms a portion of the wall of each corresponding pressure chamber 10.

As described above, the individual electrode 35, the piezoelectric film 41, the common electrode 34, the piezoelectric film 42, and the sub-common electrode 37 are laminated together in this order. The individual electrode 35 is positioned within a region overlapping with the portion of the wall defining the corresponding pressure chamber 10 along a direction of lamination of the piezoelectric films 41-44 and electrodes 34, 35, 37. The common electrode 34 and the sub-common electrode 37 are positioned so that the common electrode 34 and the sub-common electrode 37 at least partially overlap with the individual electrode 35 along the direction of lamination. In other words, the individual electrode 35, the common electrode 34, and the sub-common electrode 37 at least partially overlap each other along the direction of lamination at least in the region corresponding to the portion of the wall defining the pressure chamber.

<Control of the Actuator Unit>

Figure 6:
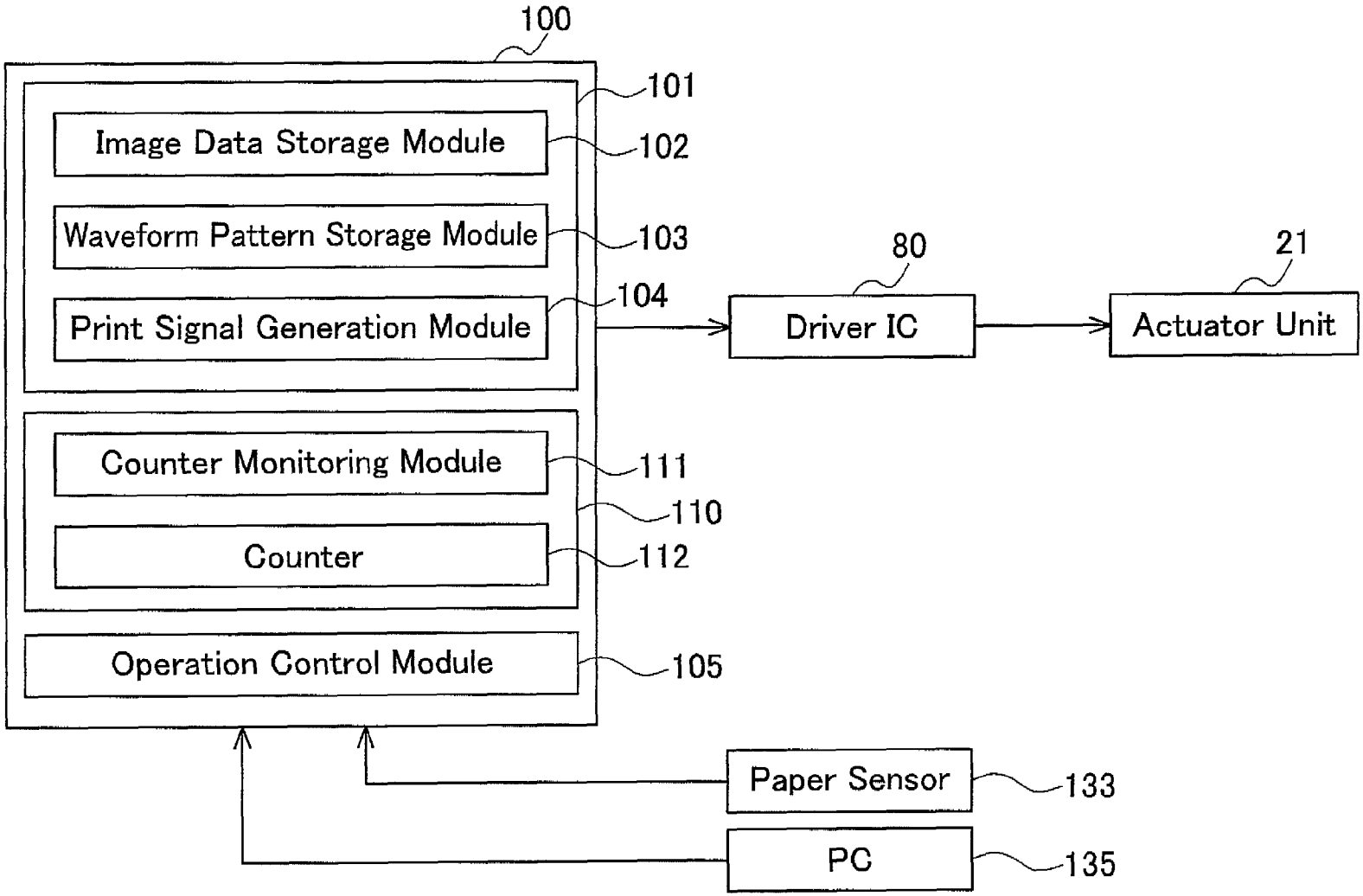
FIG. 6 is a block diagram of a controller of the inkjet printer.

The control of the actuator unit 21 will be described. FIG. 6 is a block diagram showing a control system having the printer 1.

Note that the printer 1 has a CPU (central processing unit), a ROM (read only memory) in which programs executed by the CPU and data used by the programs are stored, and a RAM (random access memory) for temporarily storing data during program execution. Each function module that is described below is formed by these elements. The CPU, ROM, and RAM are omitted from the drawings.

The control system of the printer 1 includes a controller 100, a driver IC 80, the actuator unit 21, and the paper sensor 133 (see FIG. 1). The driver IC 80 and the paper sensor 133 are electrically connected to the controller 100. The actuator unit 21 is electrically connected to the driver IC 80.

The controller 100 has a print control module 101, a counter module 110, and an operation control module 108. Operation data and image data related to printing will be transmitted from the paper sensor 133 and an external PC (personal computer) 135 to the controller 100. The operation control module 108 will control the operation of a motor that drives the paper supply rollers 145, motors that drive the feed rollers 118*a*, 118*b*, 119*a*, 119*b*, 121*a*, 121*b*, 122*a*, 122*b*, a conveyor motor 174, and the like.

The counter module 110 comprises a counter 112 and a counter monitoring module 111. The counter 112 counts a count of matching a predetermined condition. The predetermined condition is, for example, a condition of ink being discharged, a condition of elapsing a certain time period. If the condition is set as the condition of elapsing a certain time period, a count counted by the counter 112 means a time that the printer 1 has been used since the start of printer 1 use. The counter 112 increments the count according to clock numbers, the number of ink discharges, or another predetermined condition. The counter monitoring module 111 determines whether the count held in the counter 112 meets the predetermined value. If the count meets the predetermined number, the counter monitoring module 111 transmits a signal indicating that the count meets the predetermined number to the print control module 101. The counter monitoring module 111 may have a function to determine whether the count meets the predetermined number at the request of the print control module 101 and relay the result to the print control module 101 with print control.

The print control module 101 has an image data storage module 102, a waveform pattern storage module 103, and a print signal generation module 104. The image data storage module 102 stores image data transmitted from the PC 135 or the like that is to be printed.

Figure 10:
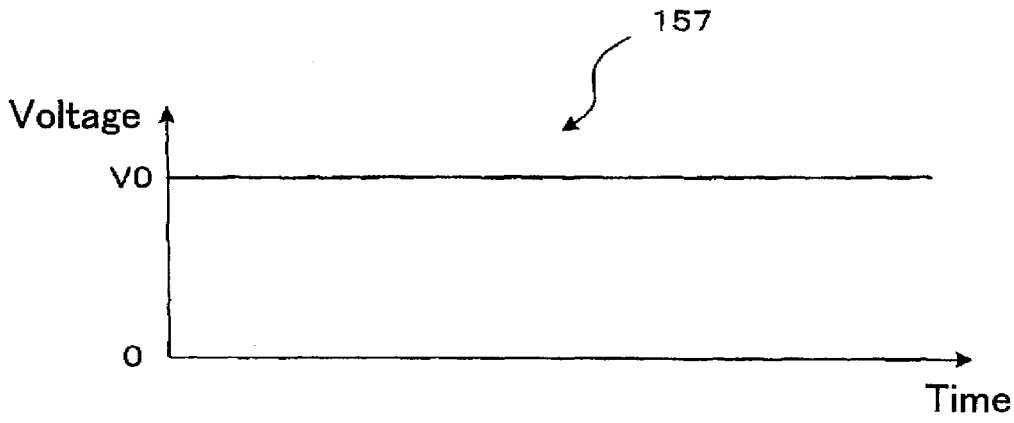
FIG. 10 is a schematic drawing of an example of a laminated active portion signal.
Figure 11:
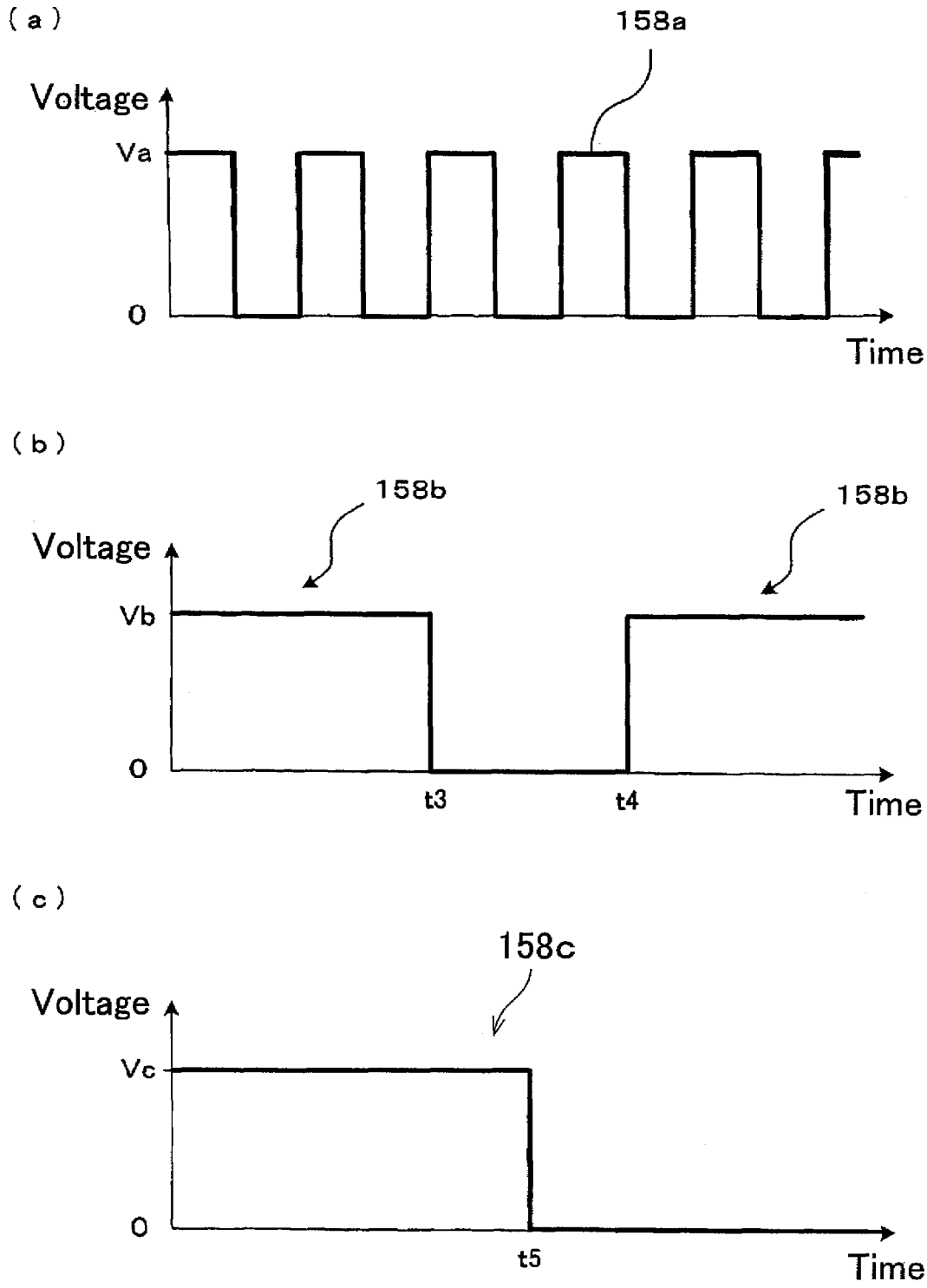
FIGS. 11(*a*)-(*c*) are schematic drawings of other examples of the laminated active portion signals.

The waveform pattern storage module 103 stores a plurality of types of ink discharge signal pattern 155 (see FIG. 7) and laminated active portion signal (additional signal) pattern 157 and 158 (see FIGS. 10 and 11). Each respective signal pattern is actually comprises a voltage pulse train signal. Each respective signal pattern is transmitted from the controller 100 to the actuator unit 21 via the driver IC 80.

The ink discharge signal pattern 155 is a basic signal pattern for expressing image tone. By using this type of signal pattern, a quantity of ink that corresponds to each respective tone can be discharged by the inkjet head 2.

The laminated active portion signal pattern 157, as will be discussed later, is a signal pattern for applying voltage to the laminated active portion of the piezoelectric film 42. The application of voltage to the laminated active portion allows the direction of the spontaneous polarization of the crystal grain units to be changed in the laminated active portion of the piezoelectric film 42.

The print signal generation module 104 will generate image data based upon the image data stored in the image data storage module 102. The print data is data in serial format. The print signal generation module 104 will output the generated print data to the driver IC 80 that corresponds to each actuator unit 21.

The print signal generation module 104 selects signal patterns to be output to the individual electrodes 35 from among the plurality of signal patterns stored in the waveform pattern storage module 103 so that the desired image is printed. Print data is generated according to the selected signal pattern. Print data also includes data designating the timing of the output of the selected signal pattern to the driver IC 80. More specifically, the print signal generation module 104 generates print data corresponding to the ink discharge signal pattern 155 for discharging ink at a specified timing from the specified nozzle 8.

The print signal generation module 104 also derives the timing for the application of the laminated active portion signal pattern 157 to the sub-common electrode 37 according to signals from the counter monitoring module 11 and the state of printing. The print signal generation module 104 generates print data corresponding to the laminated active portion signal pattern 157 at the derived timing.

The print data generated by the print signal generation module 104 is transmitted to the corresponding driver IC 80.

The driver IC 80 has a shift register, a multiplexer, and a drive buffer. The shift register, the multiplexer, and the drive buffer are omitted from the drawings.

The shift register will convert print data in serial format that was output from the print signal generation module 104 to data in parallel format. Simultaneously therewith, the shift register will convert print data to individual data for the actuator 50 that corresponds to each pressure chamber 10 and nozzle 8. The converted data will be output to the multiplexer.

The multiplexer will select a suitable signal pattern from among the plurality of types of ink discharge signal patterns and laminated active portion signal patterns, based upon the data output by the shift register. The multiplexer will output, the selected data to the drive buffer.

The drive buffer will generate ink discharge signal having suitable voltage levels for driving the actuator 50, based upon the ink discharge signal pattern output from the multiplexer. Concurrently, the drive buffer will generate a laminated active portion signal (an additional signal) with a voltage level appropriate for driving the actuator 50 based on the laminated active portion signal patterns output from the multiplexer. More specifically, these signals are also voltage pulse train. The drive buffer will apply the generated ink discharge signal to the individual electrodes 35 that correspond to each actuator 50, via the FPC. Similarly, the drive buffer will apply the generated laminated active portion signal to the sub-common electrode 37 corresponding to each of the actuators 50 via the FPC.

<Transition of Electric Potential of the Individual Electrodes During an Ink Discharge Operation>

The ink discharge signal, and the transition of electric potential of the individual electrode 35 that received the signal, will be described. For the purposes of the foregoing description, a printing interval T0 is defined as the amount of time needed to convey a printing sheet P a distance corresponding to a printing resolution, along the direction in which the printing sheet P is conveyed. In other words, the printing interval T0 means the minimum amount of time needed after ink is discharged from one nozzle 8 for ink to be discharged therefrom again. The printing interval T0 is set by the speed at which the printing sheet P is conveyed, and the printing resolution of the printer 1.

The voltage included in the ink discharge signal at each point in time will be described FIG. 7(*a*) is a schematic diagram showing a waveform 155 of an ink discharge signal applied from the driver IC 80 to the actuator unit 21. Note that the waveform 155 of the ink discharge operations signal shown in FIG. 7 is an example of a waveform for causing one drop of ink to be discharged from a nozzle 8 in a printing interval T0 during a printing period.

Time t1 is the time at which the ink discharge signal starts to be applied to individual electrode 35. Time t2 is the time at which the ink discharge signal ends. The voltage change at the time t1 is referred to as an advanced voltage change at a start timing of ink discharge signal. The voltage change at the time t2 is referred to as a subsequent voltage change at an end timing of ink discharge signal. The time t2 is adjusted at the timing at which ink is discharged from nozzle 8 that corresponds to the individual electrode 35. The time period Tw from the advanced voltage change at the timing t1 to the subsequent voltage change at the timing t2 of the ink discharge signal 155 is set to satisfy a relation that the subsequent voltage change at the timing t2 is applied when positive pressure is developed within the pressure chamber due to the pressure wave generated by the advanced voltage change at the timing t1.

The voltage will be kept at a predetermined V0 in a period Ta that is prior to the start timing t1 of the ink discharge signal and a period Tc that is after the end timing t2 of the ink discharge signal. The voltage will be kept at zero in period Tb. In other words, the ink discharge signal 155 comprises the advanced voltage change from the predetermined voltage V0 to zero voltage and the subsequent voltage change from zero voltage to the predetermined voltage V0. The subsequent voltage change is delayed form the advanced voltage change for the period Tb.

Figure 7:
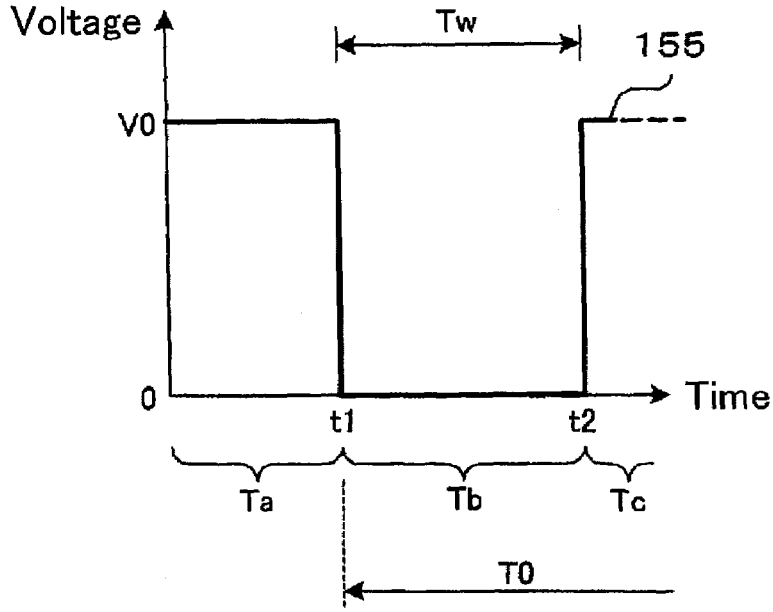
FIG. 7(*a*) is a schematic drawing of an ink discharge signal.
Figure 7:
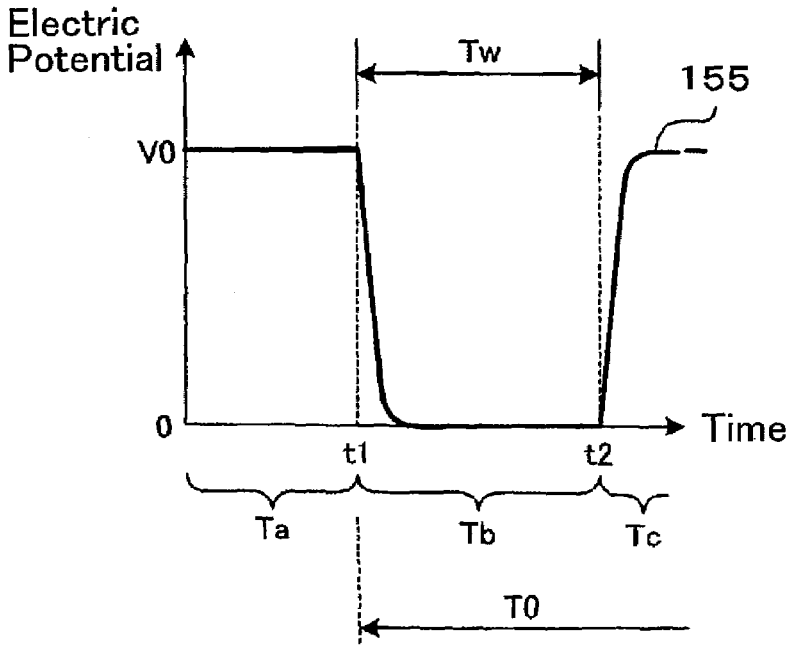

FIG. 7(*b*) shows the transition of electric potential at the individual electrode 35 when the waveform 155 of the aforementioned ink discharge signal is applied to the individual electrode 35.

As shown in FIG. 4, the individual electrode 35 and the common electrode 34 have a function that is equivalent to a condenser due to the piezoelectric film 41 acting as a dielectric. Thus, as shown in FIG. 7(*b*), the electric potential at the individual electrode 35 will transit including the delay corresponding to the charge/discharge time of the condenser.

<Operation of the Actuator During the Ink Discharge Operation>

How the actuator 50 will be driven by applying the aforementioned ink discharge signal to the individual electrode 35 will be described.

First, the status of the actuator unit 21 when the electric potential of the individual electrode 35 is at the potential other than ground potential (zero voltage) will be described. Only the uppermost piezoelectric film 41 of the actuator unit 21, in the present embodiment, is polarized along a direction extending from the individual electrode 35 to the common electrode 34. By making the electric potential of the individual electrode 35 different than that of the common electrode 34, a voltage can be applied to the piezoelectric film 41 in the same direction as of the polarized direction. When a voltage is applied to the piezoelectric film 41, the portion in which the voltage is applied, i.e., the main active portion, will extend in the thickness direction due to the piezoelectric effect (the direction in which the piezoelectric films 41-44 are laminated). In addition, the main active portion will contract in a direction that is perpendicular to the direction of lamination, i.e., the planar direction of the piezoelectric film 41. Because the piezoelectric film 42-44 are laminated together with the piezoelectric film 41, the films 42-44 are passively deformed due to the deformation of the film 41 when the voltage is applied between the individual electrode 35 and the common electrode 34.

Figure 8:
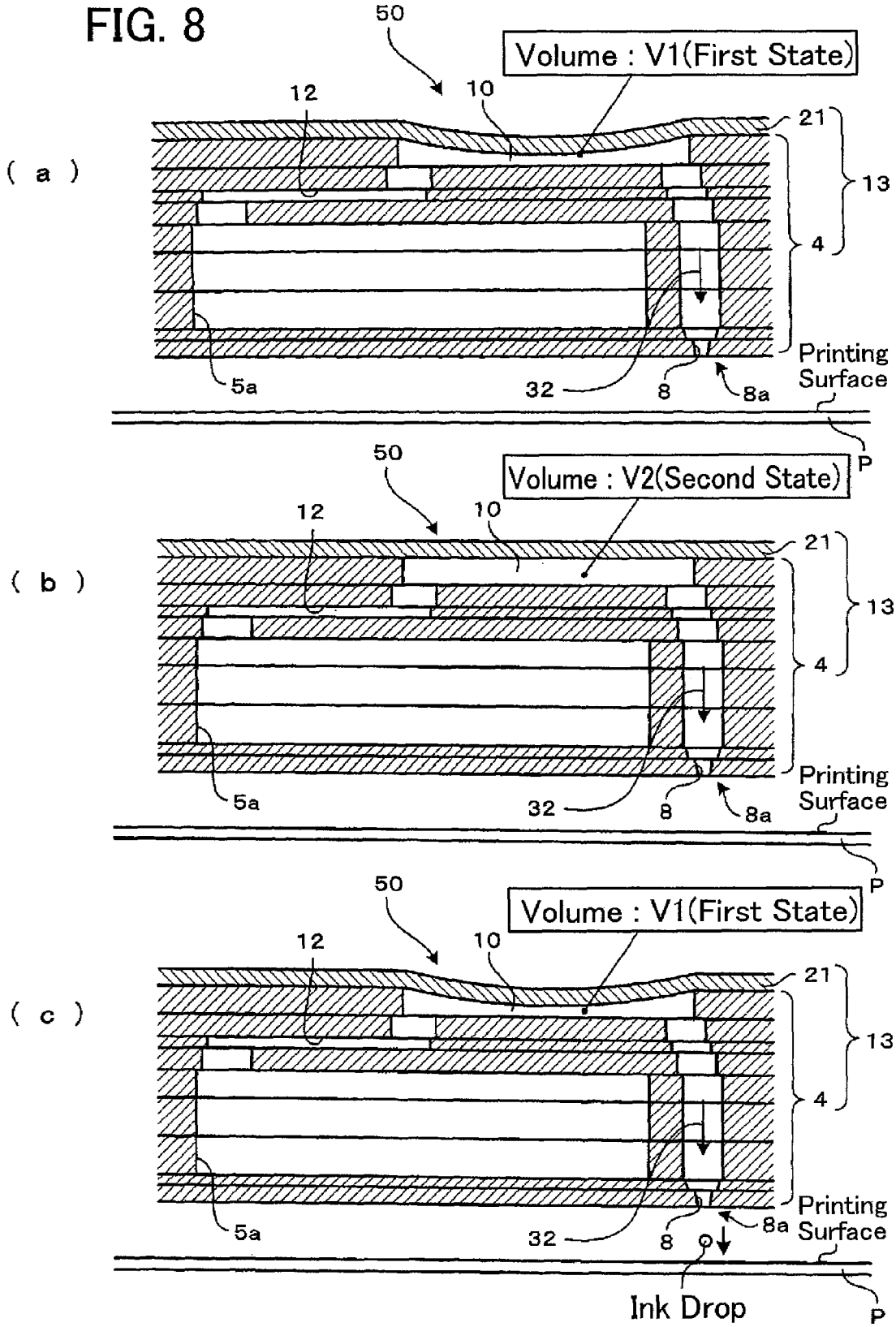
FIGS. 8(*a*)-(*c*) are explanatory drawings illustrating an operation of the actuator unit when the ink discharge signal shown in FIG. 7(*a*) is applied.

Next, the operation of the actuator 50 when an ink discharge signal 155 is applied to the individual electrode 35 will be described. FIGS. 8(*a*)-(*c*) show transition of the state of the actuator 50 during the ink discharge operation in this case. As shown in FIGS. 8(*a*)-(*c*), the actuator unit 50 forms the upper wall of the pressure chamber 10.

FIG. 8(*a*) shows the state of the actuator 50 during period Ta shown in FIG. 7(*b*). At this period, the electric potential of the individual electrode 35 is at the predetermined voltage V0. In contrast, the common electrode 34 is always kept at ground potential (see FIG. 4). The actuator 50 deforms due to unimorph deformation so as to project toward the inside of the pressure chamber 10. The volume of the pressure chamber 10 at this period is V1. In other words, when the predetermined voltage V0 is applied to the individual electrode 35, the volume of the pressure chamber 10 will be V1. The state of the actuator 50 at this period will be referred to as the first state.

FIG. 8(*b*) shows the state of the actuator 50 during period Tb shown in FIG. 7(*b*). At this period, the electric potential of the individual electrode 35 is zero voltage (ground potential). In other words, the main active portion of the piezoelectric film 41 of the actuator 50 is in a state in which a zero voltage is applied. Thus, the unimorph deformation of the actuator 50 is released. The volume of the pressure chamber 10 at this period is V2. In other words, when a zero voltage is applied to the individual electrode 35, the deformation of the actuator 50 is released and as a result, the volume of the pressure chamber 10 becomes V2. The volume V2 of the pressure chamber 10 is larger than the volume V1 of the pressure chamber 10 shown in FIG. 8(*a*). The state of the actuator 50 at this period will be referred to as the second state. Thus, as a result of the increase in the volume of the pressure chamber 10 from V1 to V2, ink will be drawn into the pressure chamber 10 from the submanifold passage 5*a*.

FIG. 8(*c*) shows the state of the actuator 50 during period Tc shown in FIG. 7(*b*). At this period, the electric potential of the individual electrode 35 is returned to V0. Thus, the actuator 50 will return again to the first state. By changing the actuator 50 from the second state to the first state, the pressure of the ink inside the pressure chamber 10 will increase. In this way, an ink drop will be discharged from the ink discharge opening 8*a* in the tip of the nozzle 8. The ink drop will strike the printing surface of the printing sheet P and form a dot on the printing sheet P.

Thus, during the ink discharge operation of the actuator 50, the volume of the pressure chamber 10 will first become temporarily enlarged (from the state shown in FIG. 8(*a*) to the state shown in FIG. 8(*b*)), and a negative pressure will be generated within the ink in the pressure chamber 10. The generated negative pressure will cause a pressure wave. The pressure wave will propagate the ink passage formed inside the passage unit 4. This pressure wave will propagate through the ink, and will reflect at the end portions of the ink passage. One end of the ink passage is the aperture 12. The other end of the ink passage is the nozzle 8. The pressure wave changes from a negative pressure to a positive pressure when reflected. The reflected pressure wave will return to the pressure chamber 10. When the pressure wave returns to the pressure chamber 10, positive pressure is developed within the pressure chamber 10. Subsequent voltage change from zero voltage to the predetermined voltage V0 is applied to the individual electrode 35 when the pressure wave returns to the pressure chamber 10 and positive pressure is developed within the pressure chamber 10.

The period Tw of the ink discharge signal 155 from the advanced voltage change at timing t1 to the subsequent voltage change at timing t2 is ideally the time that AL (Acoustic Length) is divided by penetrating speed of the pressure wave. Here, AL is the distance from the aperture 12 to the nozzle 8. The pressure chamber 10 is just a middle position between the aperture 12 and the nozzle 8. Note that the period Tw, in which the voltage of the individual electrode 355 changes from V0 to ground voltage, and again returns to V0, is substantially equivalent to the period in which the volume of the pressure chamber 10 changes from V1 to V2, and again returns to V1.

By making the period Tw as described, the positive pressure generated by the reflected pressure wave in the pressure chamber 10 will be superimposed over the positive pressure generated by the deformation of the actuator 50. In this way, a stronger positive pressure can be applied to the ink. Thus, as compared with simply reducing the volume of the pressure chamber one time in order to push ink out, the drive voltage of the actuator 50 for discharging the same quantity of ink can be reduced. Therefore, the aforementioned ink discharge operation is useful for increasing the integration of the pressure chambers 10, making the inkjet head 2 more compact, and reducing the running cost when driving the inkjet head 2. The aforementioned ink discharge operation is referred to as "fill before fire".

<Change in the Characteristics of the Piezoelectric Actuator>

It has been confirmed that when ink is continuously discharged for a long period of time under certain conditions by means of the aforementioned "fill before fire" method, changes will occur in the discharge characteristics of the actuator 50. For example, in the case where the actuator 50 is capable of being driven at a drive frequency that is more than 20 kHz, the ink discharge signals 155 will be supplied at a frequency that is much lower than the drive frequency. Then, after the ink discharge signals are applied a million times at a low frequency, a quantity of ink discharged from the nozzle 8 will decline. Also, the speed of the ink discharged from the nozzle is slowed. For example, when one million ink discharge signals are applied to the actuator 50 at 20 kHz, a prominent change in the discharge characteristics of the actuator 50 was not observed. However, when one million ink discharge signals were supplied to the actuator 50 at 2 kHz, a prominent change in the discharge characteristics of the actuator 50 was observed. In other words, when the ink discharge signals 155 are supplied to the actuator 50 at a frequency that is lower than the fastest drive frequency, a change in the discharge characteristics of the actuator 50 will occur. On the other hand, there was almost no change in the discharge characteristics of the actuator 50 when the voltage V0 is continuously applied to the actuator 50 for a period that one million ink discharge signals are applied of at 2 kHz.

Figure 9:
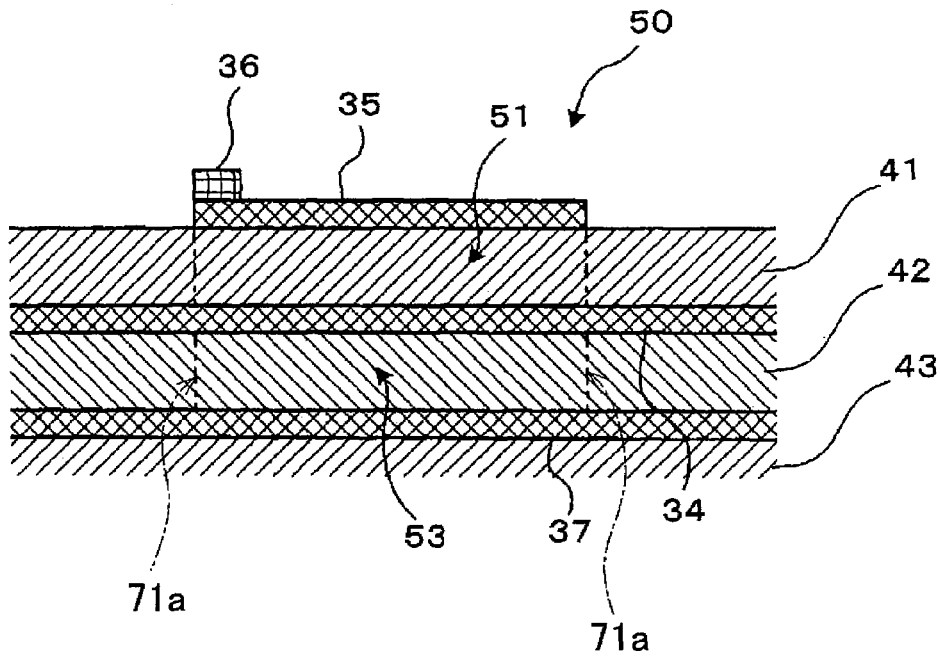
FIGS. 9(*a*), 9(*b*) are explanatory drawings illustrating a change in piezoelectric characteristics occurring in the actuator unit shown in FIG. 4.
Figure 9:
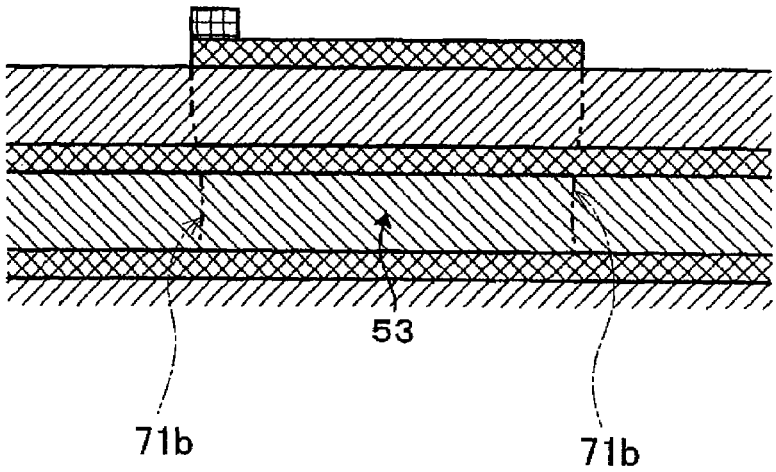

This type of change in the characteristics of the actuator 50 is assumed to be caused by the following mechanism. FIG. 9 explains the changes in the characteristics of the actuator 50.

The polarization of the piezoelectric film 41 will be explained prior to explaining the specific mechanism of the change in characteristics. The polarization of the piezoelectric film 41 is performed in order to increase the amount that the piezoelectric film contracts when a voltage is applied thereto. The polarization of the piezoelectric film is generally performed by applying a high voltage at a high temperature.

Ferroelectrics such as PZT have crystal grain units that have spontaneous polarization. However, there are various orientations of the spontaneous polarization of these crystal grain units prior to the polarization of the piezoelectric film. In this case, the piezoelectric film is not as a whole, polarized along a uniform direction. In contrast, when a high voltage is applied to the piezoelectric film at a high temperature as described above, the direction of the spontaneous polarization of each crystal grain units can be placed in a particular direction. In this way, the piezoelectric film as a whole can be polarized along the particular direction. The expression "the direction of the spontaneous polarization can be placed along the particular direction" means that the direction of the spontaneous polarization for majority of the crystal grain units can be placed along a direction close to a single common direction. The expression does not mean that the direction of the spontaneous polarization for all of the crystal grain units is placed exactly in the single common direction. In other words, such expression in this embodiment means that the piezoelectric film, as a whole, can be polarized. Such kind of expressions is used as same meanings in this specification. In the present embodiment, the piezoelectric film 41 is substantially polarized along the direction of lamination. In other words, in the present embodiment, the piezoelectric film 41 is substantially polarized along a direction extending from the individual electrode 35 to the common electrode 34.

Here, the changes prior to the polarization of certain crystal grain units in the piezoelectric film, and the changes after the polarization thereof, will be considered. Each respective crystal lattice included in the crystal grain units, and each respective crystal lattice unit, have spontaneous polarization. Crystal lattices that are assembled in a spontaneous polarization direction are gathered inside the crystal grain unit, and form a large number of domains. Spontaneous polarization of crystal grain unit expresses the total amount of spontaneous polarization in the domains that are distributed inside the crystal grain unit. Prior to the aforementioned polarization process, the directions of the spontaneous polarization of de domains are random, and the crystal grain units as a whole do not exhibit piezoelectric characteristics. In contrast, by polarizing the piezoelectric film, the crystal grain unit will exhibit piezoelectric characteristics, because the directions of spontaneous polarization of the domains inside the crystal grain unit align along the common direction (the direction in which the piezoelectric films 41-44 are laminated in the present embodiment).

Even if a polarization process is performed, the polarization directions of all the crystal lattices inside the crystal grain unit will not be aligned perfectly along the single common direction. There are domains inside the crystal grain unit after polarization in which the direction of spontaneous polarization aligns with the common direction, and there are also domains in which the directions of spontaneous polarization do not align with the common direction. Because these domains tend to have a certain distribution tendency, the crystal grain units as a whole will be polarized in the uniform direction. In the following explanation, the term "c-axis orientation" will be used to refer to the spontaneous polarization direction of each domain in a crystal grain being close to the lamination direction. In addition, the term "a-axis orientation" will be used to refer to the spontaneous polarization direction of each domain in a crystal grain being close to a direction that is perpendicular to the lamination direction (the lamination plane direction). Note that the degree of c-axis orientation that represents the extent of the c-axis orientation is observed as the intensity ratio of a 002 diffraction pattern with respect to 200 diffraction in X-ray diffraction. Amongst these, the 002 diffraction corresponds to the diffraction tom a plane oriented on the c-axis of the crystal axis.

The mechanism by which piezoelectric characteristics change in the piezoelectric film 41 and the piezoelectric film 42 will be explained below. As noted above, when ink is not discharged from the nozzle 8 corresponding to the actuator 50, a fixed voltage V0 is applied between the individual electrode 35 and the common electrode 34 (period Ta and Tc in FIG. 7). At these periods, the main active portion 51 in the piezoelectric film 41 that is sandwiched between the individual electrode 35 and the common electrode 34 will contract along the planar direction of the piezoelectric film 41.

The laminated active portion of the piezoelectric film 42 sandwiched by the common electrode 34 and the sub-common electrode 37 contains an opposing portion 53 that faces the main active portion 51. Thus, the opposing portion 53 suffers compressive stress in the planar direction from the main active portion 51 when the main active portion is deformed due to the piezoelectric effect.

When the ink discharge signals 155 are applied to the individual electrode 35, the contraction of the active portion 51 will be temporarily released during the period Tw (see FIG. 7). The active portion 51 will return to the contracted state thereafter. Thus, the compressive stress received by the opposing portion 53 is also temporarily released during period Tw, and the opposing portion 53 will return again to a compressive stress state.

In this type of situation, the ink discharge signals 155 will be continuously applied to the individual electrode 35 at a predetermined low frequency. When this occurs, the degree of c-axis orientation in the opposing portion 53 will gradually increase and will not return to the former state. If the degree of c-axis orientation in the opposing portion 53 will increase, the deformation of the opposing portion 53 caused by the compressive stress fails to return when the compressive stress is released. In other words, the shape of the opposing portion shifts from its initial shape. As shown by the broken line 71 in FIG. 9(*b*), the opposing portion 53 will therefore be in a state that is contracted along the planar direction more than the initial state 71*a* shown in FIG. 9(*a*). Thus, the active portion 51 will suffer compression stress from the contracted opposing portion 53.

Thus, the main active portion 51 will receive compression stress from the opposing portion 53. In this way, the degree of c-axis orientation in the main active portion 51 will increase, and the distribution of the crystal orientation inside the crystal grain units in the main active portion 51 will change from its initial state.

The displacement that occurs when an external voltage is applied to a polarized piezoelectric film is primarily observed as the sum of the warping due to electrostriction that deforms in the c-axis direction of c-axis oriented crystal lattices, and the warping caused by changes in the orientation of the domains (rotation of the crystal axis). However, in a state in which compression stress is steadily applied from the periphery, the domains that can change orientation by application of an external voltage will be reduced. As a result, the displacement of the main active portion 51 due to changes in the internal structure of the crystal grain units will be reduced. The decrease of the displacement of the main active portion 51 means the decrease of deformation of the actuator 50 when voltage is applied to the main active portion 51. Consequently, it means the decrease of volume change of the pressure chamber 10 during ink discharge operation. The decrease of volume change causes the decrease of the amount of ink discharged from the nozzle 8 by ink discharge operation and also causes slowing of the speed of ink discharged from the nozzle 8. In other words, the long-term use of an inkjet printer results in a change of the characteristics of the piezoelectric actuator from the initial characteristics and a consequent change of ink discharge characteristics.

<Operation of the Actuator by Means of Laminated Active Portion Signals>

The laminated active portion signals (the additional signals) applied to the sub-common electrode 37 will be discussed. FIG. 10 shows one example of the laminated active portion signal 157 applied to the sub-common electrode 37.

The laminated active portion signal 157 is applied to cause the polarization of the opposing portion 53 (FIG. 9). The laminated active portion signal 157 may be applied in the manufacturing process of the printer 1. The laminated active portion signal 157 shown in FIG. 10 is a signal held at the voltage V0. The laminated active portion signal 157 is applied to the sub-common electrode 37. The common electrode 34 facing the sub-common electrode 37 and sandwiching the piezoelectric film 42 with the sub-common electrode 37 is held at ground potential. Therefore, when the laminated active portion signal 157 is applied to the sub-common electrode 37, voltage V0 is applied to the laminated active portion along the direction of lamination. The laminated active portion includes the opposing portion 53 shown in FIG. 9(*a*)-(*b*).

FIG. 11(*a*)-(*c*) show other examples of the laminated active portion signals. The laminated active portion signals are applied in order to polarize the laminated active portion.

Note that when the laminated active portion signals such as shown in FIG. 10 or one of FIGS. 11(*a*)-(*c*) is supplied to the sub-common electrode 37, the potential of the sub-common electrode 37 will change with the delay as illustrated in FIG. 7(*b*). To avoid repetition, the details about changes in the potential of the sub-common electrode 37 are omitted.

As was discussed earlier, the degree of c-axis orientation is increased in the opposing portion 53 after polarization in comparison to the opposing portion 53 before polarization. Therefore, the potential for the degree of c-axis orientation in the opposing portion 53 to increase after polarization in comparison to the opposing portion 53 before polarization can be reduced. The polarization of the opposing portion 53 suppresses an increase of the degree of c-axis orientation in the opposing portion 53 in comparison to before polarization even if ink is continually discharged at a low frequency when the printer 1 is in use. This allows changes in the piezoelectric characteristics of the piezoelectric film 41 of the actuator 50 to be suppressed. As a result, changes in the ink discharge characteristics such as a reduction in the ink discharge amount or a slowing of ink discharge speed can be reduced.

The larger the polarization in the laminated active portion resulting from the application of laminated active portion signals, the better. But polarization in the laminated active portion is achieved to a certain level, the change of the piezoelectric characteristics of the piezoelectric film 41 can be suppressed within a certain range according to the level of polarization. In other words, the polarization of the laminated active portion to or above a certain level allows changes of the piezoelectric characteristics of the piezoelectric film 41 to be suppressed.

Moreover, the voltage of the laminated active portion signal 157 used in the polarization of the laminated active portion may be a voltage other than V0. As was noted, high voltage is used in order to polarization, so the voltage of the laminated active portion signal 157 could, for example, be made twice V0.

The laminated active portion signal 157 may be applied to the sub-common electrode 37 in the manufacturing process of the printer 1. To apply the laminated active portion signals are one of the processes of manufacturing the printer 1, however, the signals may be applied at any timing in a manufacturing process of the printer 1. After the completion of the assembly of the printer 1, for example, is acceptable. Polarizing the opposing portion 53 is performed preferably before the printer 1 is actually used.

Alternatively, the laminated active portion signals may be applied to the sub-common electrode 37 while the printer is actually in use. For example, the laminated active portion signal 157 as shown in FIG. 11 may be continuously applied to the sub-common electrode 37 while the printer 1 is actually in use.

As shown in FIG. 11(*b*), the laminated active portion signals 158*b* may be applied to the sub-common electrode 37 while the controller 100 applies no ink discharge signal, in the case where the laminated active portion signals are applied while the printer 1 is in use. In other words, the laminated active portion signals may be applied while the ink discharge operation is not performed.

As shown in FIG. 11(*b*), for example, laminated active portion signals 158*b* held at a constant voltage Vb before time t3 and after time t4. The electric potential of the sub-common electrode 37 is held at zero voltage (i.e., the ground potential) during a period between the time t3 and the time t4. In other word, the laminated active portion signals are not applied during the period between the time t3 and the time t4. In FIG. 11(*b*), the time t3 and the time t4 are determined so that the ink discharge signals are applied within the period between the time t3 and the time t4. In other words, referring FIG. 7(*a*), the time t3 and the time t4 are determined so that the time t1 and the time t2 shown in FIG. 7(*a*) are within the period between the time t3 and the time t4. The time t1 is the time at which the ink discharge signal starts to be applied to individual electrode 35. The time t2 is the time at which the ink discharge signal ends. Voltage applied to the laminated active portion may deform the laminated active portion. The deformation of the laminated active portion during the ink discharge operation affects the ink discharge characteristics. By applying the laminated active portion signals 158*b* while the controller 100 applies no ink discharge signals, it can be prevented that the laminated active portion signals 158*b* affect the ink characteristics change.

A period in which no ink discharge signal is applied includes, for example, a period in which the nozzle faces other than the printing sheet P, such as a page feeding period. If the present invention is applied to a serial head printer or the like, a period of line feeding is also included in the period in which no ink discharge signal is applied.

The laminated active portion signals are applied to the sub-common electrode 37 by the controller 100. The print control module 101 (see FIG. 6) may determine the timing for the finishing of the application of the laminated active portion signals in accordance with the counter module 110. The controller 100, for example, continuously applies the laminated active portion signals to the sub-common electrode 37 from a start of the printer 1 use. A period of applying the laminated active portion signals obviously does not include periods in which the printer 1 is off. The counter 112 of the counter module 110 counts the total driving time from the start of the printer 1 use to the present time based on the clock count. When the count reaches a predetermined number, the counter monitoring module 111 of the counter module 110 informs the print control module 101 that the count reaches the predetermined number. The print control module 101 ends the application of the laminated active portion signals in accordance with the information. FIG. 11(*c*) illustrates a case in which the application of a laminated active portion signal 158*c* held at constant voltage Vc is ended at time t5. Subsequent to the time t5, the laminated active portion signals are not applied, and no voltage is applied between the common electrode 34 and the sub-common electrode 37. The degree of c-axis orientation of the opposing portion 53 can be adequately increased by the time t5, reducing the increase in the degree of c-axis orientation of the opposing portion 53 after the time t5 even if the ink discharge operation is repeated at a low frequency after the time t5. By not applying the laminated active portion signals after the time t5, the power consumption of the printer 1 can be reduced.

The laminated active portion signals may be signals having a variety of waveforms regardless of whether they are applied during manufacture or during use. The laminated active portion signals, for example, may be signals with a waveform alternating between zero voltage and the voltage Va with a certain time interval as shown in FIG. 11(*a*).

<Electrical Conductivity Between Cavity Plate and Sub-Common Electrode>

The buildup of static electricity in the printing sheet P fed during printing can cause the ink in the pressure chamber 10 formed in the cavity plate 22 to become charged. It is open the case that the plates (plates 22-30) forming the passage unit 4, which includes the cavity plate 22, are made of metal. In this case, difference of electric potential builds between the cavity plate 22 and the sub-common electrode 37. When the difference of electric potential builds, the charged ink is pulled toward the sub-common electrode 37, which nay lead to the invasion of ink into the actuator unit 21. Ink invading into the actuator unit 21 may change the ink discharge characteristics of the actuator 50.

Figure 12:
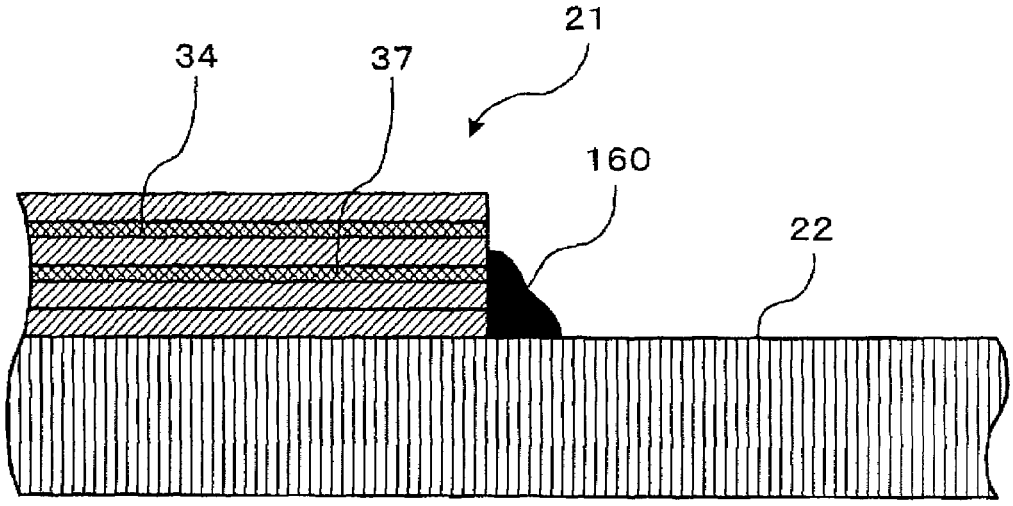
FIG. 12 is a partial enlarged cross-sectional view of an area near the end of the actuator unit in the head main body shown in FIG. 2.

To prevent the invasion of ink into the actuator unit 21, an electro-conductive adhesive 160 as shown in FIG. 12 may be adhered on the metal cavity plate 22. The electro-conductive adhesive 160 is provided so as to adhere to the edge of the actuator unit 21 adhered to the cavity plate 22 and the cavity plate 22. Moreover, the electro-conductive adhesive 160 may be provided so as to make contact up to the sub-common electrode 37 extending to the edge of the actuator unit 21. Thereby, the cavity plate 22 and the sub-common electrode 37 are electrically connected and the electric potential therebetween becomes equal.

If the laminated active portion signals are applied to the sub-common electrode 37 in the manufacturing process of the printer 1, ink is not present in the pressure chamber 10. No such ink invasion problem occurs, so the electro-conductive adhesive 160 need not be applied in the manufacturing process. But if the laminated active portion signals are applied to the sub-common electrode 37 during use of the printer 1 after the printer 1 has been manufactured, the sub-common electrode 37 takes on a potential other than ground potential. There is consequently the possibility of the aforementioned ink invasion problem. Therefore, the electro-conductive adhesive 160 gives the effect stated earlier when the laminated active portion signals are applied during use of the printer 1.

The cavity plate 22 forming the pressure chamber 10 and the sub-common electrode 37 need not necessarily be kept at the same electric potential. Any configuration is suitable as long as the ink in the pressure chamber 10 is not pulled to the sub-common electrode 37 due to a difference in electric potential with the sub-common electrode 37.

Figure 13:
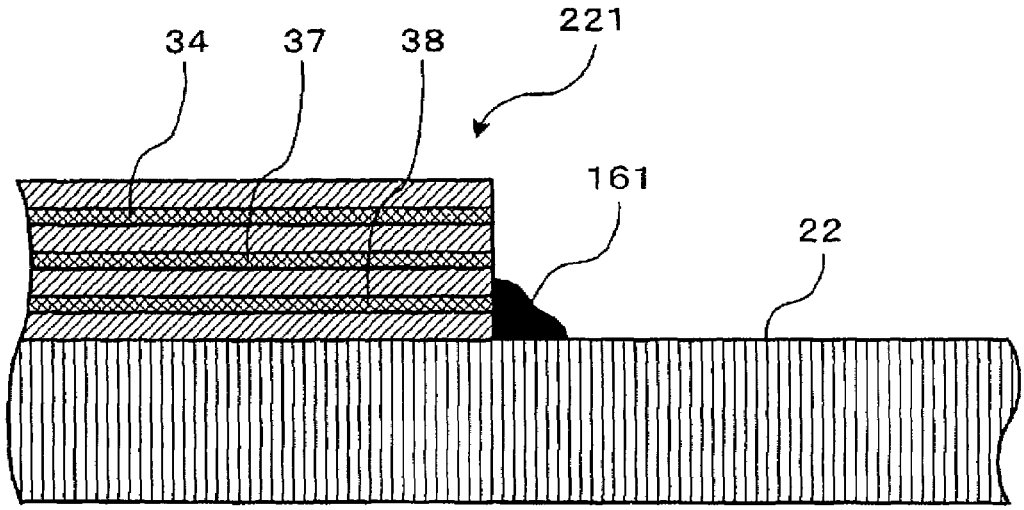
FIG. 13 is a partial enlarged cross-sectional view of an area near the end of an actuator unit differing from the actuator unit shown in FIG. 12.

The printer may also have the configuration shown in FIG. 13, for example. An actuator unit 221, shown in FIG. 13, comprises the common electrode 34, the sub-common electrode 37, and additionally a fourth electrode 38. The fourth electrode 38 is arranged between the piezoelectric film 43 and the piezoelectric film 44. The fourth electrode 38 extends in the planar direction, over almost the entire surface, between the piezoelectric film 43 and the piezoelectric film 44. In other words, the fourth electrode 38 is arranged between the sub-common electrode 37 and the pressure chamber 10. The fourth electrode 38 extends along the sub-common electrode 37, beyond the region corresponding to the pressure chamber 10.

The fourth electrode 38 and an electro-conductive adhesive 161 make contact at the end of the actuator unit 221. The fourth electrode 38 is electrically connected to the common electrode, which is held at ground potential, at a site not shown in the drawings. As FIG. 13 shows, the fourth electrode 38 and the cavity plate 22 are electrically connected by the electro-conductive adhesive 161. The cavity plate 22, i.e. the pressure chamber 10 and the fourth electrode 38, are maintained at the same potential. As stated earlier, the fourth electrode 38 is arranged between the sub-common electrode 37 and the pressure chamber 10. With this configuration, the ink in the pressure chamber 10 can be prevented from being pulled to the sub-common electrode 37 due to a difference in electric potential with the sub-common electrode 37. The invasion of ink into the actuator unit 221 can be prevented.

If the sub-common electrode 37 is formed so that the sub-common electrode 37 does not protrude from the end of the actuator unit 221 in this case, the common electrode 34 and the fourth electrode 38 can be electrically connected to the cavity plate with the electro-conductive adhesive 161 at the end of the actuator unit 221.

<Printer Manufacturing Process>

Figure 14:
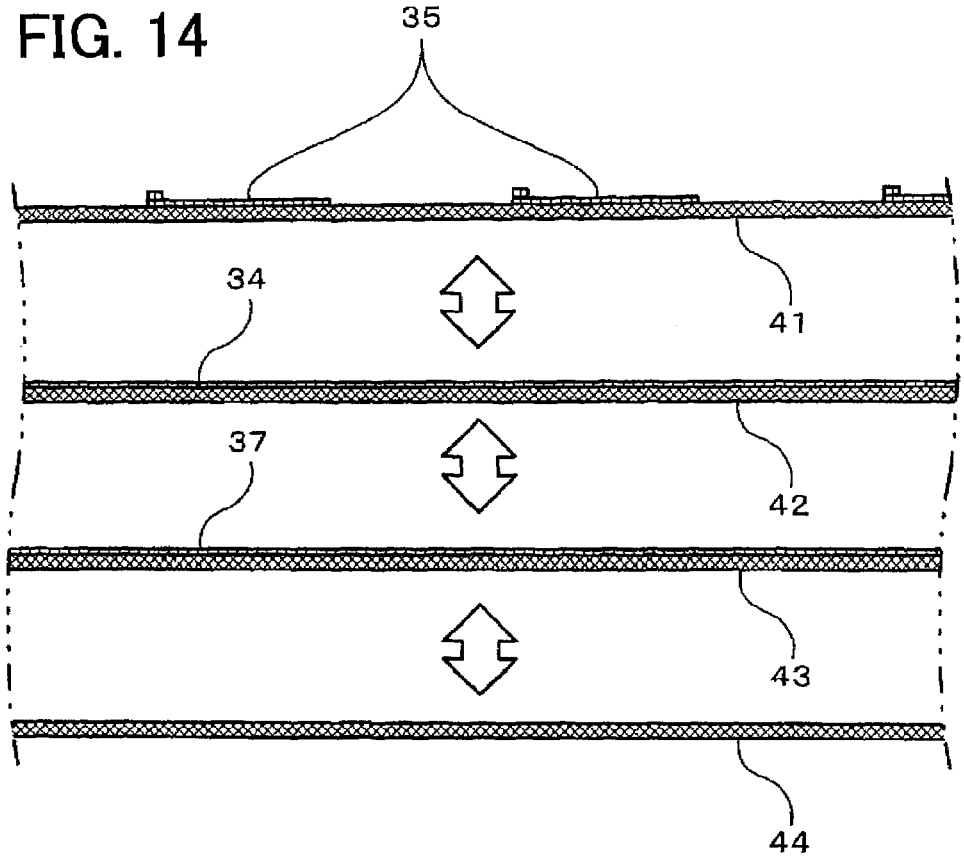
FIG. 14 is an explanatory drawing illustrating a process of forming the actuator unit shown in FIG. 4.
Figure 15:
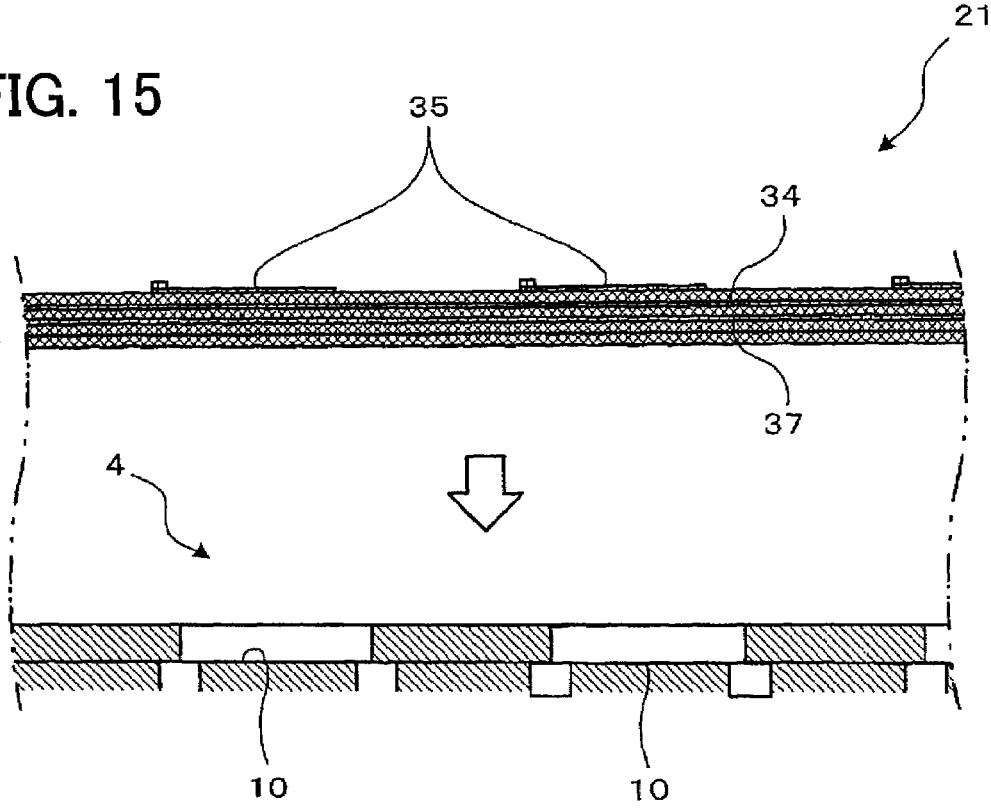
FIG. 15 is an explanatory drawing illustrating a process of connecting the actuator unit and the passage unit shown in FIG. 4.
Figure 16:
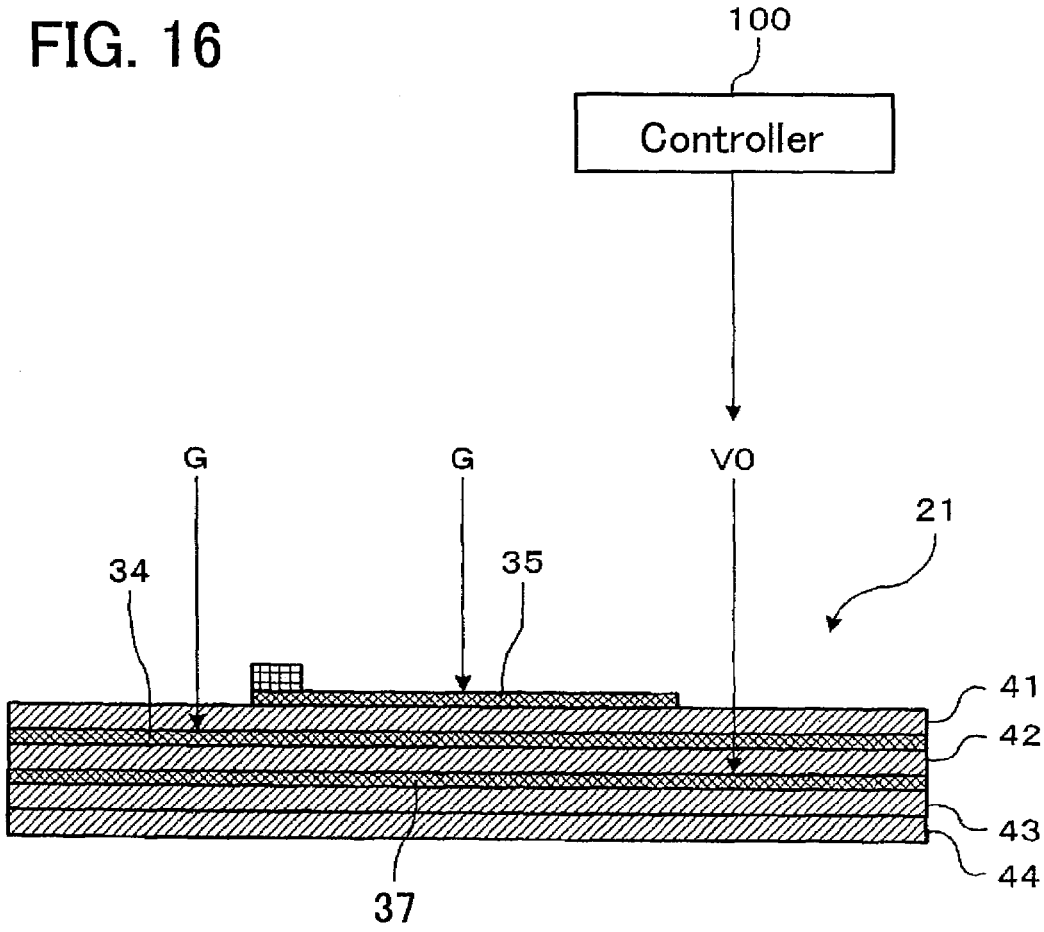
FIG. 16 is an explanatory drawing illustrating a process of applying voltage to the actuator unit.

Next, a manufacturing process of the printer 1 will be discussed. FIGS. 14 to 16 illustrate the processes followed in the manufacture of the printer 1.

<Actuator Manufacturing Process>

The process for manufacturing the actuator unit 21 is discussed here. First, a PZT ceramic powder, a binder, and a solvent are mixed to obtain a mixture adjusted to a viscosity of 10,000 to 30,000 CPS. The mixture is spread over a resin film such as polyethylene terephthalate (PET), and dried to form a green sheet. One green sheet may have a planar size much greater than the planar size of this plurality of actuator units 21. Therefore, a plurality of piezoelectric films may be formed from a single green sheet.

Next, an electro-conductive paste is printed and formed on the surface of a green sheet that is to be the piezoelectric film 41. The individual electrode 35 is thereby formed. The electro-conductive paste is printed and formed on the surface of a green sheet that is to be the piezoelectric film 42 to form the common electrode 34 having a region facing the individual electrode 35. The electro-conductive paste is printed and formed on a green sheet that is to be the piezoelectric film 43 to form the sub-common electrode 37 having a region facing the individual electrode 35. Then, the green sheets that form these respective electrodes are dried.

Next, the dried green sheets are stacked on each other in the direction of the arrow in FIG. 14 and in the following order from top to bottom: piezoelectric film 41, piezoelectric film 42, piezoelectric film 43, and piezoelectric film 44. Thereby, the piezoelectric film 41 is sandwiched with the individual electrode 35 and the common electrode 34. Furthermore, the piezoelectric film 42 is sandwiched with the common electrode 34 and the sub-common electrode 37.

Next, pressure is applied to the stacked green sheets in the direction of stacking. The individual green sheets are thereby given a unitary construction. Then, regions corresponding to the actuator units 21 are cut from the stacked and unified green sheets. Next, the stacked and cut green sheets corresponding to the actuator units 21 are baked. The actuator units 21 are thereby completed.

<Passage Unit Manufacturing Process and Actuator Connecting Process>

Here, the process for forming the passage unit 4 and the process for connecting the formed actuator units 21 to the formed passage unit 4 are discussed.

First, the passage unit 4 in which the nozzles 8 and the pressure chambers 10 are formed is manufactured under another process not shown in the drawings. In the passage unit 4, each nozzle 8 is communicated with corresponding pressure chamber 10 as shown in FIG. 4. More specifically, a plurality of plates (plates 22-30 in FIG. 4) with communication holes formed with etching is prepared. Each plate is positioned and stacked so that the communication holes communicate with each other to form the individual ink passages 32. A passage unit 4 with the individual ink passages 32 is thus manufactured.

As FIG. 4 shows, the pressure chamber 10 is formed on the cavity plate 22 stacked at the top of the passage unit 4. Therefore, one surface of the pressure chamber 10 is opened toward the outside of the passage unit 4.

Next, an adhesive is coated on the upper surface (the surface on the side of the cavity plate 22) of the passage unit 4. The actuator unit 21 is stacked on the passage unit 4 and adhered in the direction of the arrow in FIG. 15. Thus, the actuator unit 21 and the passage unit 4 are connected.

Here, the actuator unit 21 is positioned so that the respective pressure chambers 10 and the individual electrodes 35 face each other and is also aligned on the cavity plate. The actuator unit 21 is thereby aligned at the position where the main active portion, which is sandwiched between the individual electrodes 35 and the common electrode 34, faces the pressure chamber 10 in the piezoelectric film 41. In other words, the actuator unit 21 is connected to the passage unit 4 so as to cover the opened portion of the pressure chamber 10.

With the actuator unit 21 fixed to the passage unit 4 in this manner, the lower portion facing the main active portion in the actuator unit 21 is formed so as to project into the pressure chamber 10 when voltage is applied between the individual electrode 35 and the common electrode 34. In summary, the actuator unit 21 is connected to the passage unit 4 so that the volume of the pressure chamber 10 when voltage is applied to the main active portion is smaller than the volume when voltage is not applied.

<Application of Laminated Active Portion Signals>

Leads from the outside are electrically connected to the sub-common electrode 37 and the individual electrodes 35 of the actuator unit 21 connected to the top of the passage unit 4. The leads are not shown in the drawings. As FIG. 16 shows, the controller 100 applies the laminated active portion signal 157 to the sub-common electrode 37 via the leads. At this time, the common electrode 34 and the individual electrodes 35 are grounded in a region not shown in the drawings and are kept at ground potential G. The sub-common electrode 37 is held at the constant electric potential V0. In other words, the controller 100 applies the voltage V0 between the common electrode 34 and the sub-common electrode 37. The laminated active portion of the piezoelectric film 42 is thereby polarized. This polarization may be performed with the polarization of the main active portion. The value of the electric potential on the individual electrodes 35 is held constant. The value of the electric potential on the sub-common electrodes 37 is also held constant. The value of the electric potential on the individual electrodes 35 and the value of the electric potential on the sub-common electrodes 37 may be equal or different.

The laminated active portion signals need not be applied by the controller 100 of the printer 1. Immediately after the actuator unit 21 is completed, for example, a control device different from the controller 100 may be connected to the sub-common electrode 37 for applying the laminated active portion signals. The timing of the application of the laminated active portion signals can be selected at any time but after the actuator unit 21 is completed.

<Completion of the Printer>

With applying the laminated active portion signals between the common electrode 35 and the sub-common electrode 37 in this manner, the head main body 13 completes. The completed head main body 13 and other components are assembled to complete the inkjet head 2. The inkjet head 2, paper supply unit 114, and other components are assembled to complete the printer 1. The printer 1 can be manufactured by performing above described processes.

<Modifications>

Although preferred embodiments of the present invention are described above, the present invention is not limited to the embodiments described above, and various design modifications are possible within the scope of the claims.

For instance, the microscopic structural changes occurring in the main active portion in the above embodiment and the consequent changes in piezoelectric characteristics occur due to the present of the opposing portion facing the main active portion, which is sandwiched by the individual electrodes 35 and the common electrodes 34 in the piezoelectric film 42.

The piezoelectric film 41 and the piezoelectric film 42 of the actuator unit 21 may have a structure that does not extend so as to cover the pressure chamber 10. The above-mentioned changes in piezoelectric characteristics may also occur if the piezoelectric film 41 and the piezoelectric film 42 are provided only within the region facing the pressure chamber 10, provided that the main active portion faced the opposing portion. Therefore, the present invention is also applicable to an inkjet printer with an actuator unit in which the piezoelectric film 41 and the piezoelectric film 42 are provided only within the region facing the pressure chamber 10.

Figure 17:
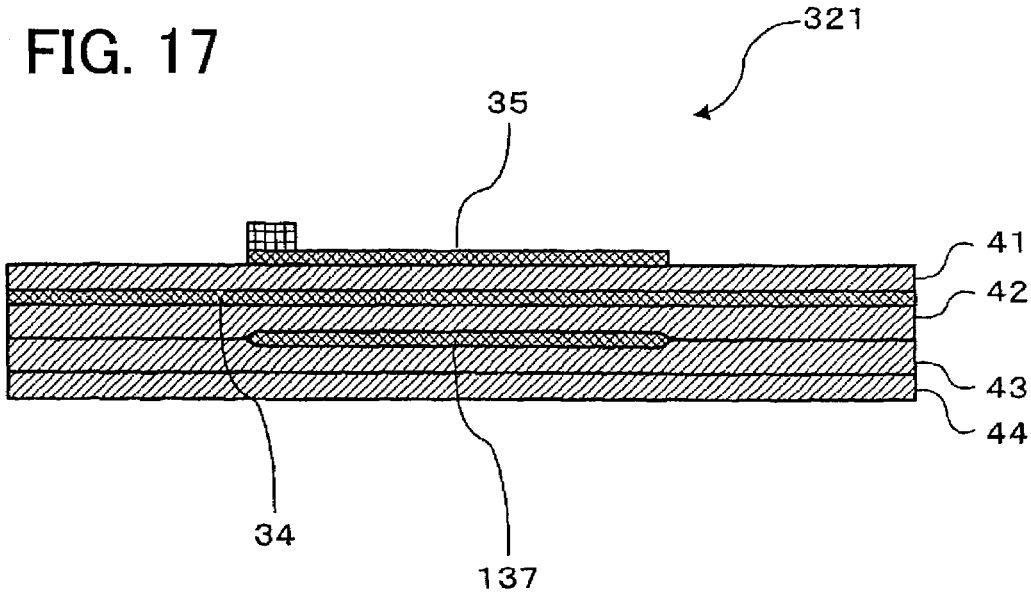
FIG. 17 is a cross-sectional view of an actuator unit different from the actuator unit shown in FIG. 4.

The actuator unit may have the structure shown in FIG. 17. An actuator unit 321 comprises an electrode 137 instead of the sub-common electrode 37. The electrode 137 extends along planer direction between the piezoelectric film 42 and the piezoelectric film 43, but extends only in the region facing the individual electrodes 35. The electrode 137 and the common electrode 34 sandwich only the region facing the individual electrodes in the piezoelectric film 42. In this configuration as well, the application of voltage between the electrode 137 and the common electrode 34 causes the application of voltage to the opposing portion in the piezoelectric film 42, thus polarizing the opposing portion. The changes in the piezoelectric characteristics of the main active portion of the piezoelectric film 41 are thereby reduced even if the printer is used for a long time.

The common electrode 34 may by electrically connected to the print control module 101 (FIG. 6) via an FPC. This may allow the application of a variety of voltage signals to the common electrode as well. The voltages applied between the individual electrodes 35 and the common electrode 34 and the voltages applied between the sub-common electrode 37 and the common electrode 34 may be precisely controlled.

In the aforementioned embodiment, a line head type of inkjet head is used that is fixed to a printer body. However, the present invention can be applied to an inkjet printer having a serial type of inkjet head. In addition, the inkjet printer may also be of a type which moves the inkjet head in the conveying direction with respect to the printing sheet P.

Preferably, The piezoelectric film 42 in the above embodiment may be as thin as possible. The piezoelectric film 42 may be formed thinner than the piezoelectric film 41 within a range not leading to dielectric breakdown due to the voltages applied. The reasons are discussed here.

The compressive stress the piezoelectric film 42 undergoes in the planar direction due to the compression of the main active portion 51 (FIG. 9) in the planar direction is greatest near the main active portion 51. The change in the characteristics occurring in the piezoelectric film 42 due to the stress conferred by the main active portion 51 is therefore most pronounced near the main active portion 51. When the characteristics of the portion near the main active portion 51 change, that portion more readily confers compression stress to the main active portion 51 than does the portion distant from the main active portion 51. With the piezoelectric film 42 thin, the portion sandwiched by the common electrode 34 and the sub-common electrode 37 in the piezoelectric film 42 includes only a portion near the main active portion 51. Therefore, voltage is applied with a more appropriate laminated active portion signals to the portion which easily changes in characteristics of the piezoelectric film 42. Even if voltage signals of identical magnitude are applied, the piezoelectric film 42 is thin, so a larger electric field is applied to the opposing portion 53. Therefore, changes in the construction of the opposing portion 53 are more effectively suppressed.

In the above embodiment, the voltage applied between the individual electrodes 35 and the common electrode 34 during the ink discharge operation has the waveform shown in FIG. 7(*a*). As shown in FIG. 7(*a*), in the ink discharge signals, the predetermined voltage applied between the individual electrode 35 and the common electrode 34 during the period Ta before the time t1 and the period Tc after the time t2 is set at V0. The lower voltage applied between the individual electrode 35 and the common electrode 34 during the period Tb is set to zero voltage. The lower voltage need not be zero voltage.

The above-mentioned piezoelectric characteristic changes could occur in the piezoelectric actuator even when the second voltage is set to a value less than the first voltage. But even in this situation, the application of the present invention will provide an inkjet printer that the change of the ink discharge characteristics rarely change even if a inkjet printer are used for a long time.

What is claimed is:

1. An inkjet printer comprising:

a pressure chamber communicating with a nozzle, the pressure chamber capable of being filled with ink;

a piezoelectric actuator having a first piezoelectric film, a second piezoelectric film, a first electrode, a second electrode, and a third electrode; and, a controller to apply voltage between the first electrode and the second electrode and between the third electrode and the second electrode independently;

wherein:

the piezoelectric actuator forms a portion of a wall defining the pressure chamber;

the first electrode, the first piezoelectric film, the second electrode, the second piezoelectric film, and the third electrode are laminated together in this order;

the first electrode is positioned within a region overlapping with the portion of the wall along a direction of lamination of the piezoelectric films and electrodes;

the second electrode and the third electrode are positioned so as to overlap with the first electrode along the direction of lamination;

the piezoelectric actuator deforms so as to project toward the pressure chamber and to decrease a volume of the pressure chamber while the controller applies voltage between the first electrode and the second electrode;

the controller applies an ink discharge signal between the first electrode and the second electrode, the ink discharge signal comprising an advanced voltage change from a predetermined voltage to a lower voltage and a subsequent voltage change from the lower voltage to the predetermined voltage wherein the combination of the volume increase and the subsequent volume decrease of the pressure chamber due to the ink discharge signal causes ink to discharge from the nozzle;

the controller further applies an additional signal between the second electrode and the third electrode;

the controller applies the ink discharge signal without applying the additional signal; and the controller applies the additional signal without applying the ink discharge signal.

2. The inkjet printer of claim 1, wherein the lower voltage is substantially equal to zero voltage.

3. The inkjet printer of claim 1, wherein the controller applies the predetermined voltage between the second electrode and the third electrode as the additional signal.

4. The inkjet printer of claim 1, wherein the controller applies constant voltage between the second electrode and the third electrode as the additional signal.

5. The inkjet printer of claim 1, wherein the second electrode is held at constant electric potential.

6. The inkjet printer of claim 1 further comprising:

a counter that counts a total driving time from a start of the printer; wherein the controller applies the additional signal until the total driving time reaches a predetermined period.

7. The inkjet printer of claim 1 further comprising:

a first electro-conductive member making electrical contact with ink filled in the pressure chamber, wherein the electric potential of the first electro-conductive member is held at the same electric potential as the third electrode.

8. The inkjet printer of claim 7, wherein the first electro-conductive member forms the portion of the wall defining the pressure chamber.

9. The inkjet printer of claim 1 further comprising:

a fourth electrode positioned between the third electrode and the pressure chamber;

wherein:

the fourth electrode extends along the third electrode beyond a region corresponding to the pressure chamber; and, the fourth electrode and the pressure chamber are maintained at a same electrical potential.

* * * * *